US008130595B2

(12) United States Patent
Ohguri et al.

(10) Patent No.: US 8,130,595 B2
(45) Date of Patent: Mar. 6, 2012

(54) CONTROL DEVICE FOR ELECTRONIC APPLIANCE AND CONTROL METHOD OF THE ELECTRONIC APPLIANCE

(75) Inventors: Hirokazu Ohguri, Kanagawa-ken (JP); Masahiro Kitaura, Kanagawa-ken (JP)

(73) Assignee: Victor Company of Japan, Limited, Yokohama (JP)

( * ) Notice: Subject to any disclaimer, the term of this patent is extended or adjusted under 35 U.S.C. 154(b) by 1226 days.

(21) Appl. No.: 11/892,703

(22) Filed: Aug. 27, 2007

(65) Prior Publication Data

US 2008/0285388 A1 Nov. 20, 2008

(30) Foreign Application Priority Data

Aug. 28, 2006 (JP) ..... P2006-230878
Jul. 2, 2007 (JP) ..... P2007-173783

(51) Int. Cl.
*G10K 11/00* (2006.01)

(52) U.S. Cl. ..... 367/198; 367/197; 367/199; 340/573.1; 340/566; 381/7; 381/56; 381/110

(58) Field of Classification Search ..... 367/197–199; 340/573.1, 566; 381/110, 56, 7
See application file for complete search history.

(56) References Cited

U.S. PATENT DOCUMENTS 5,615,271 A * 3/1997 Stevens et al. ..... 381/110
(Continued)

FOREIGN PATENT DOCUMENTS

JP 59-156024 9/1984
(Continued)

*Primary Examiner* — George Bugg
*Assistant Examiner* — Ojiako Nwugo
(74) *Attorney, Agent, or Firm* — The Nath Law Group; Jerald L. Meyer; Robert T. Burns

(57) ABSTRACT

An electronic appliance includes a microphone which detects a clapping sound, an edge signal extractor, an edge pulse generator and a judgment processing circuit. The judgment processing circuit generates a first gate having a first time width to detect whether or not a second clapping sound has been generated after elapse of a first predetermined time from a first time when the microphone detects a first clapping sound and the edge pulse generator generates the first edge pulse corresponding to the first clapping sound. Subsequently, the judgment processing circuit generates a second gate having a second time width to detect whether or not a third clapping sound has been generated after elapse of a second predetermined time from a second time when the edge pulse generator generates the second edge pulse corresponding to the second clapping sound.

14 Claims, 20 Drawing Sheets

U.S. PATENT DOCUMENTS

| | | | | |
|---|---|---|---|---|
| 2004/0141620 | A1* | 7/2004 | Mahoney | 381/56 |
| 2006/0067164 | A1* | 3/2006 | Takai et al. | 367/198 |

FOREIGN PATENT DOCUMENTS

| | | |
|---|---|---|
| JP | 01-137300 | 5/1989 |
| JP | 03-054989 | 3/1991 |
| JP | 03-184497 | 8/1991 |
| JP | 5-31483 | 4/1993 |
| JP | 06-318424 | 11/1994 |
| JP | 2006-107452 | 4/2006 |

* cited by examiner

FIG. 13

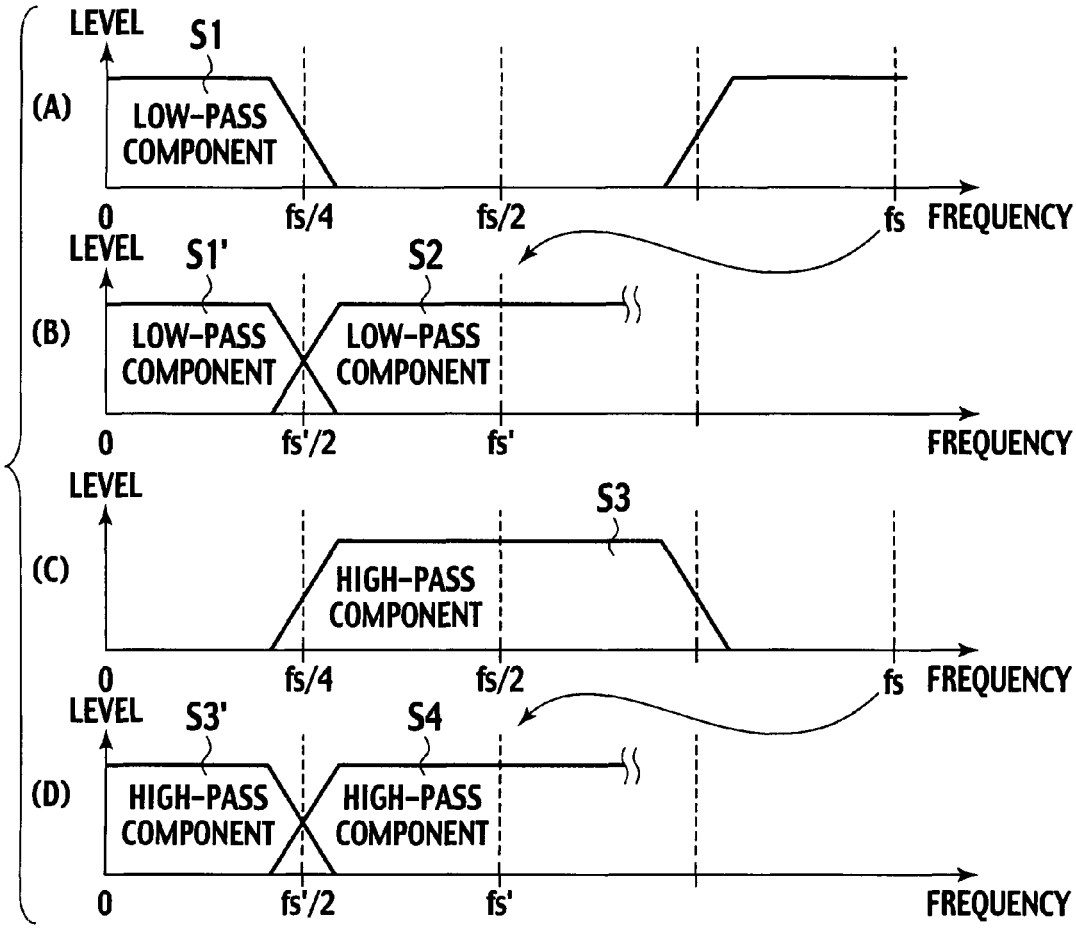

FIG. 14

| | FIRST CLAP | SECOND CLAP | THIRD CLAP |
|---|---|---|---|
| HIGH-PASS EDGE DETECTION FLAG $F_{PH}$ | ○ | × | ○ |
| LOW-PASS EDGE DETECTION FLAG $F_{PL}$ | ○ | ○ | ○ |
| CALCULATION CONTENT | LOGICAL PRODUCT | LOGICAL SUM | LOGICAL SUM |
| CALCULATION RESULT | ○ | ○ | ○ |
| FIRST EVALUATION | THERE IS CALCULATION RESULT | THERE IS CALCULATION RESULT | THERE IS CALCULATION RESULT |
| SECOND EVALUATION | | THREE OR MORE DETECTION TIMES IN TOTAL | |

| | PERIOD (T1) | PERIOD (T2) | PERIOD (T3) |
|---|---|---|---|
| CONDITIONS FOR JUDGMENT OF THREE TIMES | × | × | - |
| CONDITIONS FOR JUDGMENT OF FOUR TIMES | × | ○ | × |

CONTROL DEVICE FOR ELECTRONIC APPLIANCE AND CONTROL METHOD OF THE ELECTRONIC APPLIANCE

BACKGROUND OF THE INVENTION

1. Field of the Invention

The present invention relates to a control device for an electronic appliance and a control method of the electronic appliance. More particularly, it relates to a control device for an electronic appliance and a control method of the electronic appliance in which the electronic appliance to be controlled from a remote area with a remote controller is controlled without using any remote controller.

2. Description of the Related Art

Electronic appliances such as television receiver, audio system and air conditioner presently used are usually controlled by touching an operation button of a main body or by using a remote controller (hereinafter referred to as the RC). In the former case, an operator has to come close to the main body of the electronic appliance as a control target. When the electronic appliance is distant from the operator, the control is very laborious. This problem is solved using the RC as in the latter case.

Once the RC is taken by hand, the apparatus can be controlled without moving. However, if the RC is not near to the operator, the operator has to find out a place where the RC is present, and fetch the RC. However, in a case where the apparatus is not continuously controlled and it is desired to readily control any one operation, for example, in a case where a power supply only is turned on first of all, the operator feels troublesome. Furthermore, there often occurs a situation in which the use of the RC is desired but the RC is not found.

To solve such a problem, a method of controlling the electronic appliance with a sound which can be emitted by a person, for example, a clapping sound without using any remote operation device such as the RC has been disclosed in Japanese Patent Application Laid-Open Nos. 59-156024, 01-137300 and 2006-107452.

To control the electronic appliance with the clapping sound or the like, erroneous operations due to a surrounding noise and an unexpectedly emitted sound need to be reduced. In the above prior-art documents, to improve a resistance to the surrounding noise and the unexpectedly emitted sound, the number of clapping sounds is increased, or it is confirmed that another sound is not generated before or after a series of clapping sounds. A clapping pattern for the control of the electronic appliance is beforehand registered for each user.

However, in a case where the electronic appliance is controlled by the plurality of clapping sounds, intervals between the generated clapping sounds depend on the user, and hence the number of the clapping sounds is not correctly recognized, which might cause the erroneous operation. Furthermore, even in the case of the same user, the clapping sounds at this time might be different from the beforehand registered clapping pattern, with the result that the number of the clapping sounds might be incorrectly recognized.

SUMMARY OF THE INVENTION

An object of the present invention is to provide a control device for an electronic appliance and a control method of the electronic appliance in which the number of clapping sounds can correctly be recognized in view of intervals between generated clapping sounds that depend on a user to reduce erroneous operations. Another object of the present invention is to provide a control device for an electronic appliance and a control method of the electronic appliance in which the electronic appliance can be controlled without registering any clapping pattern beforehand.

To solve the above problem, the present invention provides (a) to (n).

(a) A control device for an electronic appliance, comprising: a sound detector (101) which detects a series of sound waves generated at predetermined time intervals for control of the electronic appliance to perform sound-electricity conversion; an edge signal extractor (107) which generates edge signals in response to generation timings of the individual sound waves in the series of sound waves based on a voice signal output from the sound detector; an edge pulse generator (108) which generates edge pulses based on the edge signals; and a judgment processing circuit (111, 114) which generates a first gate having a first time width $t_2$ to detect whether or not a second sound wave of the series of sound waves has been generated after elapse of a first predetermined time $t_1$ from a first time when a first edge pulse is generated, when the sound detector detects a first sound wave of the series of sound waves in an ungenerated state of the series of sound waves and the edge pulse generator generates the first edge pulse corresponding to the first sound wave, and which generates a second gate having a second time width $t_3$ smaller than the first time width to detect whether or not a third sound wave of the series of sound waves has been generated after elapse of a second predetermined time from a second time when a second edge pulse is generated, when the edge pulse generator generates the second edge pulse corresponding to the second sound wave within the first gate.

(b) The control device for the electronic appliance according to (a), wherein the second predetermined time is a time $t_{IN}-(t_3/2)$ obtained by subtracting a time of ½ of the second time width from a time between the first time and the second time.

(c) The control device for the electronic appliance according to (a), wherein the judgment processing circuit generates one or a plurality of m-th gates (m is an integer of 3 or more and is smaller than n by 1) to detect whether or not one or a plurality of n-th sound waves (n is an integer of 4 or more) which are fourth and subsequent sound waves of the series of sound waves have been generated, and generates the m-th gates so that intervals between adjacent gates between the second gate and the m-th gate are the second predetermined time.

(d) The control device for the electronic appliance according to (a), wherein the judgment processing circuit generates one or a plurality of m-th gates (m is an integer of 3 or more and is smaller than n by 1) to detect whether or not one or a plurality of n-th sound waves (n is an integer of 4 or more) which are fourth and subsequent sound waves of the series of sound waves have been generated, and generates the m-th gates so that intervals between adjacent gates between the second gate and the m-th gate are successively shortened.

(e) The control device for the electronic appliance according to (d), wherein after the edge pulse generator generates a third edge pulse corresponding to the third sound wave, the judgment processing circuit generates the m-th gates, respectively, at a timing obtained by reducing a predetermined error time from an interval between an n−1-th edge pulse corresponding to an n−1-th sound wave and an n−2-th edge pulse corresponding to an n−2-th sound wave.

(f) The control device for the electronic appliance according to (a), wherein when the judgment processing circuit does not detect the second and subsequent sound waves within the gates to detect the respective sound waves, the judgment processing circuit generates a no-sound flag indicating that input of the sound wave into the sound detector has stopped to determine that the input of the sound wave into the sound detector has stopped, and the judgment processing circuit generates a control signal indicating a preset control operation with respect to the number of the detected edge pulses.

(g) The control device for the electronic appliance according to (a), further comprising: a band division processing section (1101) which divides the voice signal output from the sound detector into a plurality of frequency bands and which outputs the voice signals of the plurality of divided frequency bands to the edge signal extractor, respectively, wherein the edge signal extractor generates the plurality of edge signals based on the voice signals of the plurality of frequency bands, respectively, and the edge pulse generator generates the plurality of edge pulses based on the plurality of edge signals.

(h) A control method of an electronic appliance, comprising: a sound detecting step of detecting a sound wave generated for control of the electronic appliance; a sound-electricity conversion step of subjecting the sound wave to sound-electricity conversion to output a voice signal; an edge signal generation step of generating an edge signal in response to a generation timing of the sound wave based on the voice signal; an edge pulse generation step of generating an edge pulse based on the edge signal; a first gate generation step of generating a first gate having a first time width $t_2$ to detect whether or not a second sound wave of a series of sound waves has been generated after elapse of a second predetermined time from a first time when a first edge pulse is generated, when the sound detecting step detects a first sound wave of the series of sound waves to control the electronic appliance and the edge pulse generation step generates the first edge pulse corresponding to the first sound wave, in a state where the edge pulse generation step does not generate the edge pulse for a first predetermined time $t_s$; and a second gate generation step of generating a second gate having a second time width $t_3$ smaller than the first time width to detect whether or not a third sound wave of the series of sound waves has been generated after elapse of a third predetermined time from a second time when a second edge pulse is generated, when the edge pulse generation step generates the second edge pulse corresponding to the second sound wave within the first gate.

(i) The control method of the electronic appliance according to (h), wherein the third predetermined time is a time $t_{IN}-(t_3/2)$ obtained by subtracting a time of ½ of the second time width from a time between the first time and the second time.

(j) The control method of the electronic appliance according to (h), further comprising: a third gate generation step of generating one or a plurality of m-th gates (m is an integer of 3 or more and is smaller than n by 1) to detect whether or not one or a plurality of n-th sound waves (n is an integer of 4 or more) which are fourth and subsequent sound waves of the series of sound waves have been generated, and generating the m-th gates so that intervals between adjacent gates between the second gate and the m-th gate are the second predetermined time.

(k) The control method of the electronic appliance according to (h), further comprising: a third gate generation step of generating one or a plurality of m-th gates (m is an integer of 3 or more and is smaller than n by 1) to detect whether or not one or a plurality of n-th sound waves (n is an integer of 4 or more) which are fourth and subsequent sound waves of the series of sound waves have been generated, and generating the m-th gates so that intervals between adjacent gates between the second gate and the m-th gate are successively shortened.

(l) The control method of the electronic appliance according to (k), wherein after the edge pulse generation step generates a third edge pulse corresponding to the third sound wave, the third gate generation step generates the m-th gates, respectively, at a timing obtained by subtracting a predetermined error time from an interval between an n−1-th edge pulse corresponding to an n−1-th sound wave and an n−2-th edge pulse corresponding to an n−2-th sound wave.

(m) The control method of the electronic appliance according to (h), further comprising: a flag generation step of generating a no-sound flag indicating that the absorption of the sound wave by the sound detecting step has stopped to determine that the absorption of the sound wave has stopped, when the edge pulse generation step does not generate the edge pulses corresponding to the second and subsequent sound waves within the gates to detect the respective sound waves; and a control step of generating a control signal indicating a preset control operation with respect to the number of the edge pulses generated by the edge pulse generation step.

(n) The control method of the electronic appliance according to (h), further comprising: a division step of dividing the voice signal generated by the sound-electricity conversion step into a plurality of frequency bands and generating the voice signals of the plurality of divided frequency bands, wherein the edge signal generation step generates the plurality of edge signals based on the voice signals of the plurality of frequency bands, respectively, and the edge pulse generation step generates the plurality of edge pulses based on the plurality of edge signals.

According to the present invention, when an electronic appliance is controlled with a clapping sound or the like, erroneous operations can further be reduced.

The nature, principle and utility of the invention will become more apparent from the following detailed description when read in conjunction with the accompanying drawings.

BRIEF DESCRIPTION OF THE DRAWINGS

In the accompanying drawings:

FIG. 13 is a diagram showing a frequency spectrum of each signal in a case where a band is divided into a low band and a high band in FIGS. 11A and 11B;

FIG. 14 is a diagram showing an embodiment of evaluation in a case where clapping is performed three times to define recognition;

DESCRIPTION OF THE PREFERRED EMBODIMENTS

First Embodiment

Figure 1:
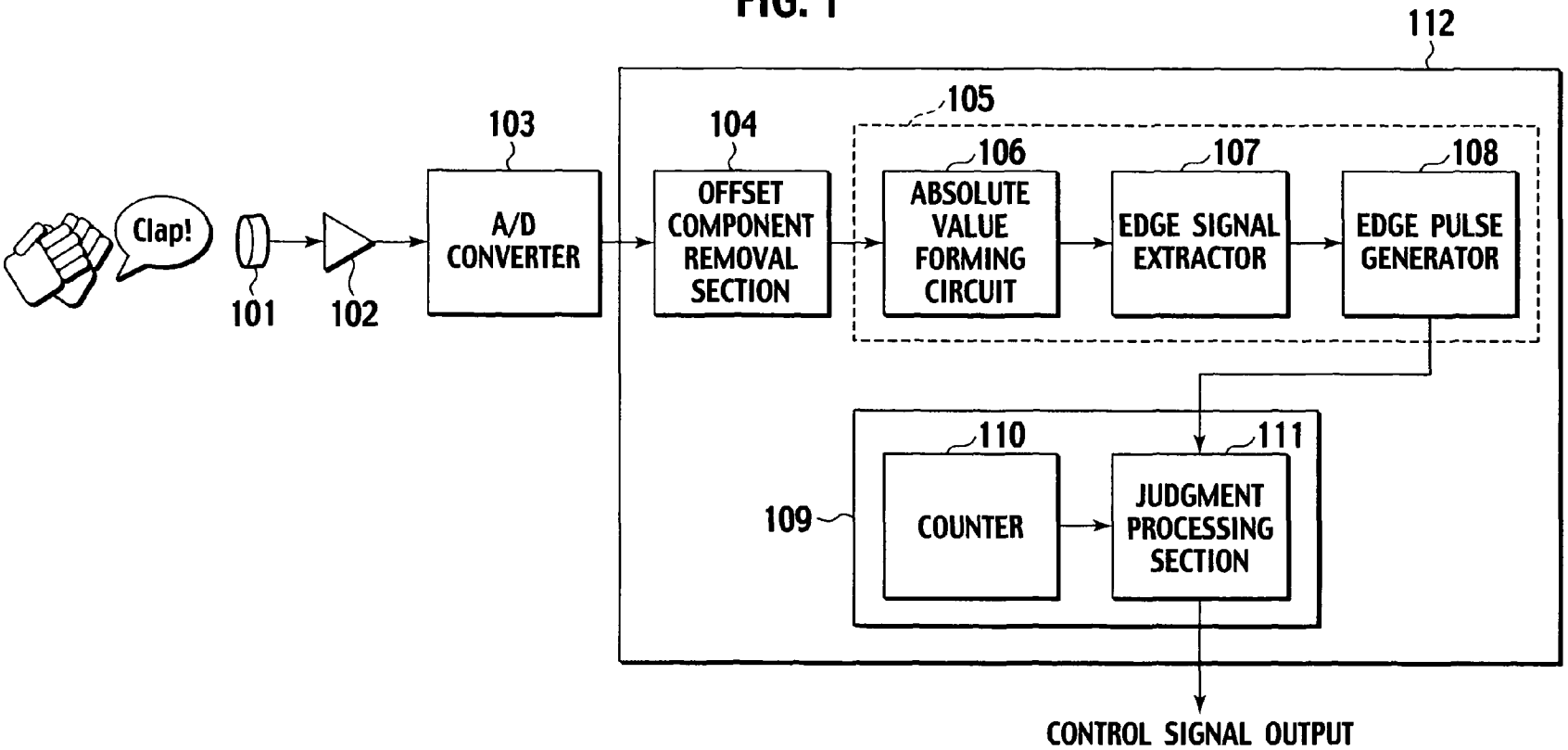
FIG. 1 is a block diagram of a first embodiment of a control device for an electronic appliance according to the present invention.

FIG. 1 is a block diagram showing a first embodiment of a control device for an electronic appliance according to the present invention. The control device for the electronic appliance is disposed in the electronic appliance, and realizes a remote operation of the electronic appliance by an operator. The control device for the electronic appliance of the first embodiment controls the electronic appliance by a series of sound waves (e.g., clapping sounds) which are generated at predetermined time intervals by the operator.

The control device for the electronic appliance of the first embodiment includes a microphone (hereinafter abbreviated as the MC) 101 which detects operator's clapping sound, an amplifier 102 which amplifies an analog voice signal from the MC 101, an A/D converter 103 which converts the analog voice signal output from the amplifier 102 into a digital signal; and a central processing unit (CPU) 112 which processes the digital voice signal output from the A/D converter 103 by software processing to detect the clapping sound, and then performs predetermined judgment processing peculiar to the present embodiment to generate and output a control signal.

The MC 101 is a sound detector which detects a series of sound waves generated at the predetermined time intervals by the operator for control of the electronic appliance and which performs sound-electricity conversion. The MC 101 outputs the analog voice signal obtained by the sound-electricity conversion of the sound waves. After the analog voice signal is amplified by the amplifier 102 to an optimum amplitude level with respect to a dynamic range of A/D conversion to be performed by the A/D converter 103 at a subsequent stage, the signal is supplied to the A/D converter 103.

The analog voice signal supplied to the A/D converter 103 is sampled at a sampling frequency fs, and converted from the analog signal into the digital signal. Subsequently, the signal is supplied to the CPU 112. It is to be noted that the sampling frequency fs is a frequency twice or more as much as the maximum frequency of an input voice signal of the A/D converter 103.

The CPU 112 includes an offset component removal section 104, a clapping sound detection processing section 105 and a judgment processing section 109. The offset component removal section 104 removes an offset component from the digital voice signal sent from the A/D converter 103, and outputs the signal to the clapping sound detection processing section 105. The offset component will be described later.

The clapping sound detection processing section 105 includes an absolute value forming circuit 106, an edge signal extractor 107 and an edge pulse generator 108. The absolute value forming circuit 106 subjects the input digital voice signal to absolute value formation processing, and the edge signal extractor 107 extracts an edge signal from the voice signal formed into an absolute value. The edge pulse generator 108 generates an edge pulse based on the extracted edge signal.

Specifically, the edge signal extractor 107 generates the edge signal according to generation timings of individual sound waves of the series of sound waves, based on the input voice signal, and the edge pulse generator 108 generates the edge pulse based on the edge signal. The clapping sound detection processing section 105 outputs the edge pulse (the edge detection flag) as a detection signal indicating that the series of sound waves have been detected.

Subsequently, the judgment processing section 109 includes a counter 110 and a judgment processing circuit 111. The judgment processing circuit 111 generates various flags based on the edge pulse supplied from the clapping sound detection processing section 105 and a counter value from the counter 110, and transmits a control signal to a control section of the electronic appliance as a control target.

It is to be noted that, in this embodiment, the processing of the digital voice signal output from the A/D converter 103 is performed by software of the CPU 112. However, the offset component removal section 104 and the clapping sound detection processing section 105 may be constituted of hardware, and even the judgment processing section 109 may be constituted of hardware. Especially, since the offset component removal section 104 and the clapping sound detection processing section 105 perform digital processing of a signal component, the sections are easily constituted of the hardware. When the sections are constituted of the hardware, the electronic appliance can easily be controlled even at a time when the electronic appliance is on standby.

Figure 2:
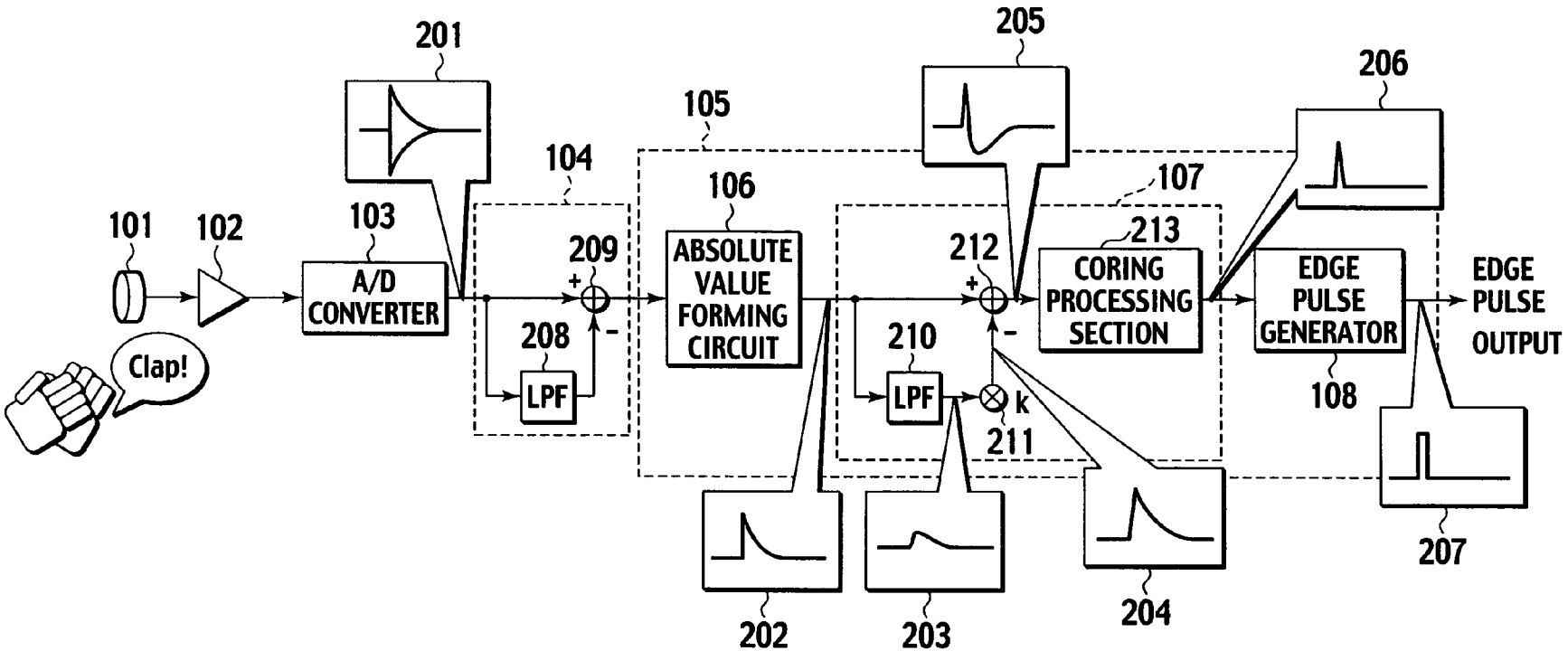
FIG. 2 is a block diagram showing an offset component removal section 104 and a clapping sound detection processing section 105 of FIG. 1 in detail.

Next, the control device for the electronic appliance according to the first embodiment shown in FIG. 1 will be described in detail in order of processing. FIG. 2 is a block diagram showing the offset component removal section 104 and the clapping sound detection processing section 105 of FIG. 1 in detail, and FIG. 3 is a diagram showing an input/output signal of the A/D converter 103.

A waveform signal 201 shown in FIG. 2 indicates a waveform signal of the digital signal converted by the A/D converter 103 from the sound wave (the clapping sound) picked up by the MC 101 through the amplifier 102.

Figure 3:
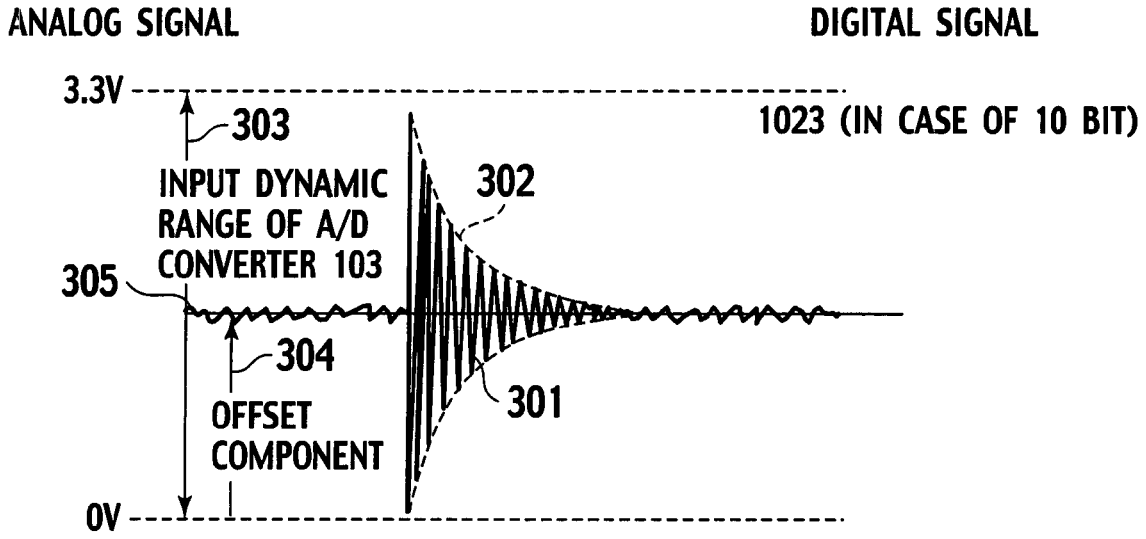
FIG. 3 is a diagram showing an input/output signal of an A/D converter 103.

Here, an actual waveform signal includes various frequency components and amplitudes as shown by a waveform signal 301 in FIG. 3. To simplify the drawing, the subsequent waveform signal is shown as an envelope curve 302 of the waveform signal 301. However, not the envelope curve 302 but the actual waveform signal 301 is subjected to the actual signal processing.

In the analog signal before A/D converted and the A/D converted digital signal, the signal component is offset with an offset component 304 in accordance with an input dynamic range 303 of the A/D converter 103. In an example shown in FIG. 3, the dynamic range 303 is of 0 V to 3.3 V. However, in the subsequent processing, the offset component 304 is unnecessary, because the component is not a processing target.

When the analog signal is converted into the digital signal by the A/D converter 103, depending on a type of the A/D converter, a voltage level is divided by a resistance to set a level 305 at a time when any sound is not emitted at the center of the dynamic range 303 of the A/D converter 103 as shown in FIG. 3. The level 305 at the time when any sound is not emitted approximately indicates an average value of the amplitudes of the waveform signal 301.

The waveform signal 201 output from the A/D converter 103 has the no-sound level at the center of the dynamic range of the A/D converter 103. The offset component removal section 104 of FIGS. 1 and 2 generates a signal having a high-frequency component thereof decayed by a low pass filter (LPF) 208 with respect to the digital voice signal of the waveform signal 201. A subtracter 209 subtracts the signal having the high-frequency component thereof decayed from the digital voice signal of the waveform signal 201 to remove the offset component.

Here, the signal having the high-frequency component thereof decayed by the LPF 208 is obtained by extracting a signal component in the vicinity of the no-sound level of the waveform signal 201. When a time constant of the LPF 208 is increased, tracking of the high-frequency component of the waveform signal 201 is delayed. Therefore, the LPF 208 can pass therethrough as much as an only first low-frequency component corresponding to the no-sound level of the waveform signal 201. That is, the LPF 208 passes therethrough the approximate average value of the amplitudes of the waveform signal 201.

The subtracter 209 subtracts an output of the LPF 208 from the waveform signal 201 to output a waveform signal so that the average value of the amplitudes of the waveform signal 201 is 0.

When the voltage level of the A/D converter 103 is divided by the resistance, the no-sound level 305 does not fall on the center of the dynamic range 303 owing to fluctuations of the resistance and a temperature characteristic in some case. To solve the problem, the waveform signal is generated using the offset component removal section 104 so that the average value of the amplitudes of the waveform signal 201 is 0, but the present invention is not limited to this method as long as a similar effect is obtained.

Moreover, the LPF 208 may be a filter capable of dividing a band, for example, a band pass filter (BPF) or a high pass filter (HPF).

Subsequently, to facilitate the subsequent processing, in the clapping sound detection processing section 105 shown in FIG. 2, the absolute value forming circuit 106 takes an absolute value of the signal output from the offset component removal section 104. A waveform signal 202 indicates a waveform signal formed into the absolute value output from the absolute value forming circuit 106, and an edge signal is extracted by the next-stage edge signal extractor 107.

In the edge signal extractor 107, first a low pass filter (LPF) 210 decays the high-frequency component based on the input waveform signal 202 to generate a waveform signal 203. A multiplier 211 multiplies the waveform signal 203 output from the LPF 210 by a constant value k to generate a waveform signal 204. A subtracter 212 supplies, to a coring processing section 213, a waveform signal 205 obtained by subtracting the waveform signal 204 from the waveform signal 202.

Here, the LPF 210 has an object to obtain appropriate delay and a waveform signal. The time constant of the LPF is set to be smaller than that of the LPF 208, and a second low-frequency component higher than the first low-frequency component in the LPF 208 is transmitted through the LPF 210. Therefore, the LPF 210 can track even a second low-frequency component such as a speaking voice and a surrounding noise included in the waveform signal 202. In consequence, the waveform signal 205 is obtained in which a rising portion of the waveform signal 202 having a high frequency is left as it is, but another portion falls negative.

Subsequently, the waveform signal 205 is subjected to coring processing to set a value to "0" by the coring processing section 213, in a case where the value is smaller than a certain threshold value. In consequence, the edge signal extractor 107 can generate a waveform signal (the edge signal) having an only sharp edge as shown in a waveform signal 206.

At this time, the threshold value of the coring processing section 213 is set to an appropriate positive value, not "0". In consequence, even remaining noises can be removed from the waveform signal 205.

The edge pulse generator 108 of FIG. 2 generates the edge pulse based on the waveform signal 206 (the edge signal) output from the edge signal extractor 107. Here, the edge signal may simply be level-sliced to generate the edge pulse. However, to further improve a resistance to the noise and sensitivity to the edge signal, a method shown in FIG. 4 is used in the present embodiment.

Figure 4:
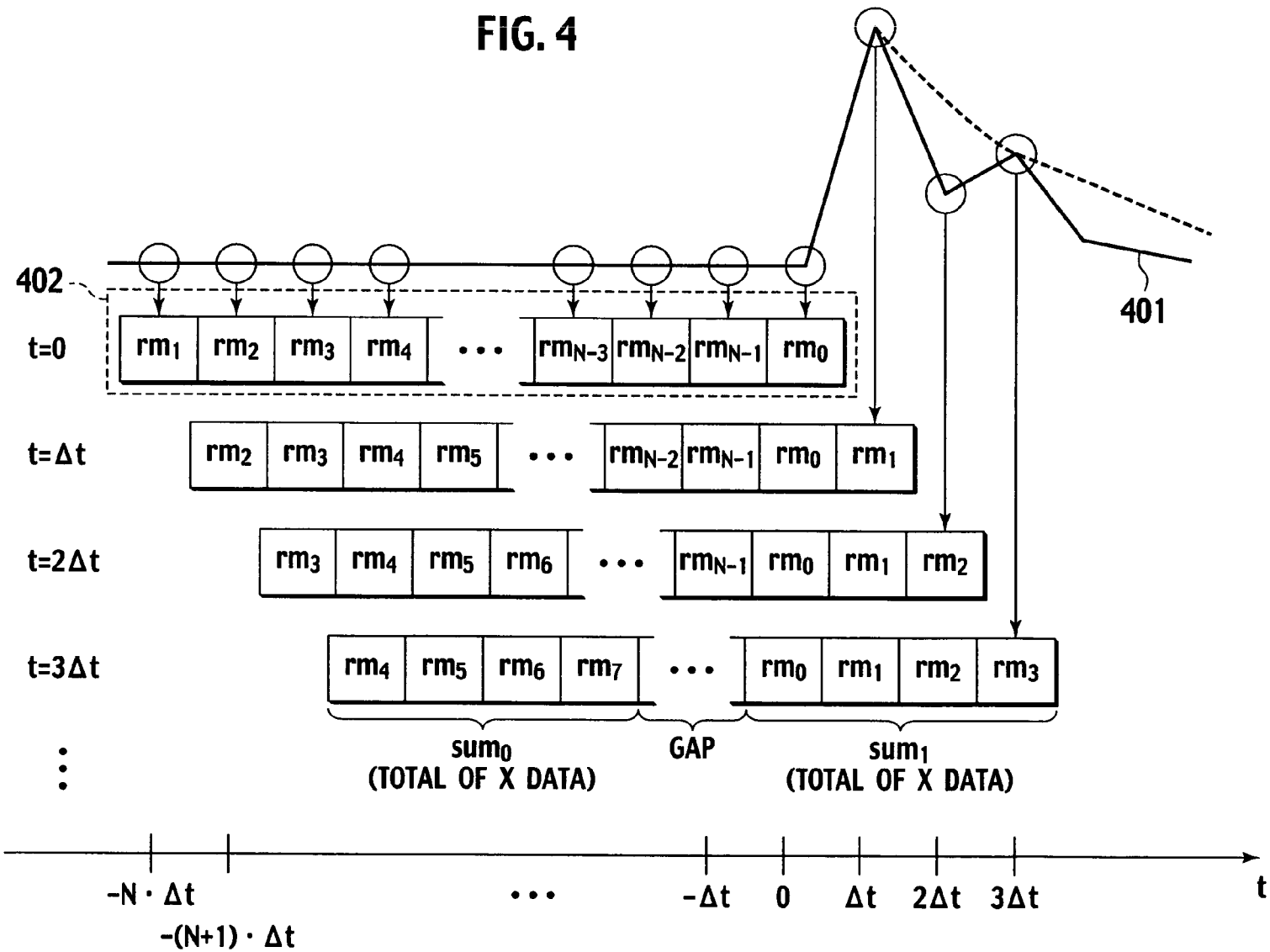
FIG. 4 is an explanatory view of an edge detection method for use in the present invention.

A waveform signal 401 shown in FIG. 4 is shown by enlarging the waveform signal 206 of FIG. 2, and circle marks indicate sampling data. The edge pulse generator 108 includes a ring memory 402 including N memories ($rm_0$ to $rm_{N-1}$) which retain the sampling data.

Assuming that the present time is t=0, the sampling data of $t=-N\cdot\Delta t$ of the waveform signal 401 is stored in a memory $rm_1$, and a value of $t=(-N+1)\cdot\Delta t$ is stored in a memory $rm_2$. Similarly, sampling data of $t=(-N+2)\cdot\Delta t, \ldots, t=0$ of the waveform signal 401 are stored in memories $rm_3, \ldots, rm_0$ in order. In the ring memory 402, the sampling data of the past N times from the present time t=0 are stored. It is to be noted that $\Delta t$ is a period of the A/D conversion to be performed by the A/D converter 103.

Subsequently, at a time $t=\Delta t$, the sampling data of $t=\Delta t$ of the waveform signal 401 is overwritten and updated in the memory $rm_1$. That is, the sampling data of the present time is stored in the memory in which the oldest sampling data (here, $t=-N\cdot\Delta t$) is stored at the present time $t=\Delta t$. The memories $rm_2$ to $rm_0$ retain a value equal to that stored at t=0. Similarly, the memories are successively updated one by one at each $\Delta t$, and the values of the past N times from the present time can be referred.

The edge pulse generator 108 judges that the edge signal has been input, when the following is satisfied:

$$sum_1-sum_0>y_{th},$$

in which, among N sampling data stored in such a ring memory 402, $sum_0$ is a sum obtained by weighted-averaging of x data (x is smaller than N) in order from the oldest stored data, and $sum_1$ is a sum obtained by weighted-averaging of x data in order from the latest stored data including the present value. The edge pulse generator outputs the edge pulse having a predetermined pulse width as shown by a waveform signal 207 of FIG. 2. In the present embodiment, a coefficient is set to ¼ to obtain a weighted average value. It is to be noted that x is set so as to obtain a time interval (a gap) between a time when the x sampling data are recorded in order from the oldest data and a time when the x sampling data are recorded in order from the newest data including the value of the present time. That is, x is set to such a value as to satisfy a relation x+x<N.

In the present embodiment, the interval is provided as described above, but x may be set so that the time when the x sampling data are recorded in order from the oldest data is adjacent to the time when the x sampling data are recorded in order from the newest data including the value of the present time. At this time, a relation x+x=N is satisfied.

Here, the waveform signal 206 obtained by the coring processing in the coring processing section 213 does not have only one large edge, and, in actual, a waveform is undulated as shown by the waveform signal 401 of FIG. 4. Therefore, the edge pulse generator 108 outputs the edge pulse having the predetermined pulse width to provide a dead zone, and it is avoided that single clapping sound is detected many times.

Moreover, $y_{th}$ described above is a threshold value of edge detection. As the threshold value decreases, the clapping sound is easily detected, but erroneous detection due to the surrounding noise or the like increases. On the other hand, as $y_{th}$ increases, the erroneous detection is reduced, but the clapping sound is not easily detected. To solve the problem, $y_{th}$ is set so that the clapping sound can correctly be detected, and the erroneous detection can be reduced as much as possible.

As in this embodiment, the edge pulse generator 108 obtains a difference from $sum_0$, $sum_1$ each obtained by the weighted-averaging of x values, instead of one amplitude value of the waveform. Therefore, a difference value of the edge signal even having a blunt waveform preferably increases. The value has a high resistance to ringing and the noise, and edge detection processing can satisfactorily be performed.

Next, the judgment processing section 109 shown in FIG. 1 will be described in detail. As described above, the judgment processing section 109 performs judgment processing peculiar to the present embodiment based on the edge pulse output from the edge pulse generator 108 and the count value from the counter 110.

Figure 5:
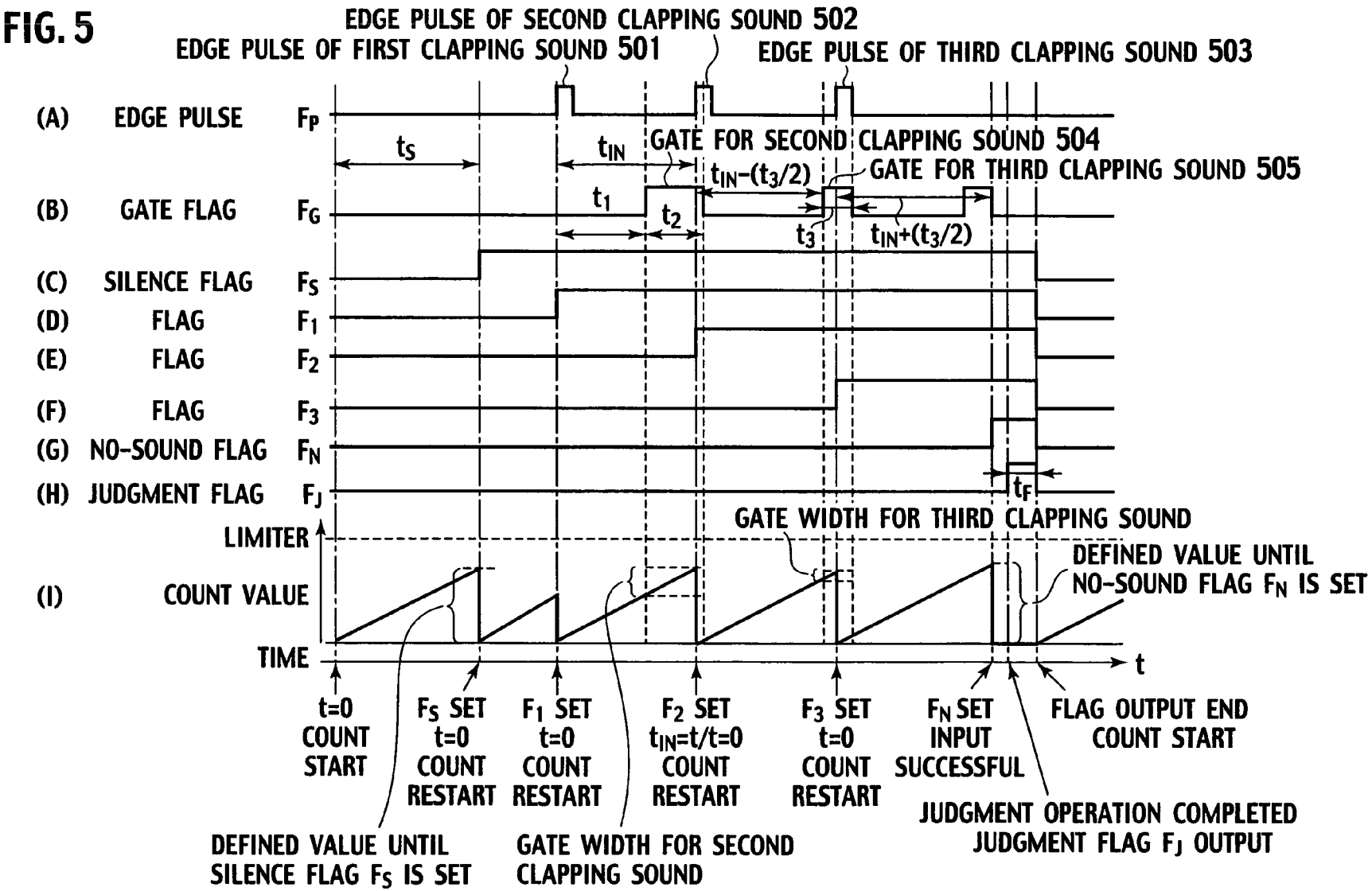
FIG. 5 is a timing chart explaining a control method according to the first embodiment of the present invention.

FIG. 5 is a timing chart showing a control method (a judgment processing algorithm) of the judgment processing section 109. FIG. 5 shows a case where three sound waves (the clapping sounds) are generated for the control of the electronic appliance. An outline will hereinafter be described.

Assuming that a period when the clapping sound or a noise similar to the clapping sound to be generated for the control of the electronic appliance is not generated is $t_s$, the judgment processing circuit 111 generates a silence flag $F_S$ shown as (C) in FIG. 5. After the silence flag $F_S$ is generated, the MC 101 detects the clapping sound which is a first sound wave generated by a user. This first sound wave is first generated in the series of sound waves to be generated for the user to control the electronic appliance at the predetermined time intervals. The edge pulse generator 108 generates a first edge pulse 501 corresponding to the first sound wave shown as (A) in FIG. 5. After elapse of a first predetermined time $t_1$ from a first time when the edge pulse generator 108 generated the first edge pulse 501, the judgment processing circuit 111 generates a gate 504 for the second clapping sound having a time width $t_2$ shown as (B) in FIG. 5 to detect whether or not a second sound wave of the series of the sound waves has been generated.

Subsequently, the user generates the second sound wave of the series of sound waves in the gate 504. The edge pulse generator 108 generates a second edge pulse 502 corresponding to the second sound wave shown as (A) in FIG. 5. After elapse of a second predetermined time $t_{IN}-(t_3/2)$ from a second time when the edge pulse generator 108 generated the second edge pulse 502, the judgment processing circuit 111 generates a gate 505 for the third clapping sound having a time width $t_3$ shown as (B) in FIG. 5 to detect whether or not a third sound wave of the series of the sound waves has been generated.

Subsequently, the user generates the third sound wave of the series of sound waves in the gate 505. The edge pulse generator 108 generates a third edge pulse 503 corresponding to the third sound wave shown as (A) in FIG. 5. After elapse of a third predetermined time $t_{IN}+(t_3/2)$ from a third time when the edge pulse generator 108 generated the third edge pulse 503, the judgment processing circuit 111 generates a no-sound flag $F_N$ indicating that input of the sound wave into the MC 101 has stopped. Moreover, the judgment processing circuit 111 generates the no-sound flag $F_N$ to determine that the input of the sound wave into the MC 101 has stopped.

Figure 6:
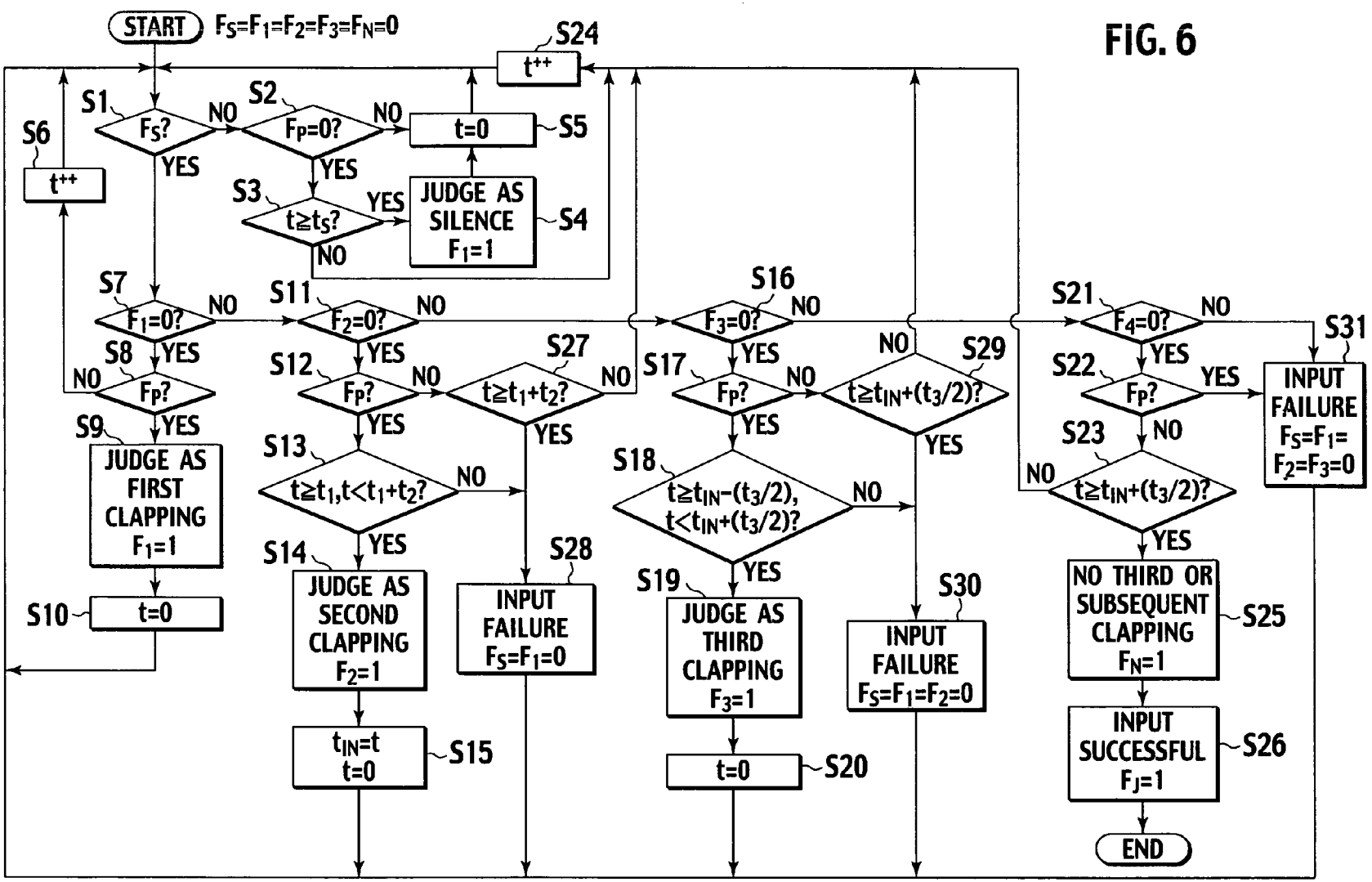
FIG. 6 is a flow chart explaining the control method according to the first embodiment of the present invention.

Next, a judgment operation of the judgment processing section 109 will be described in order with reference to the timing chart of FIG. 5 together with a flow chart of FIG. 6. In the present embodiment, a constitution example in which the silence flag $F_S$, flags $F_1$ to $F_3$ and the no-sound flag $F_N$ are all set in FIG. 5 is regarded as a preferable control method.

First, the judgment processing circuit 111 of the judgment processing section 109 judges whether or not the silence flag $F_S$ shown as (C) in FIG. 5 has been set (step S1). From a state in which the silence flag $F_S$ is not set and an edge pulse $F_P$ shown as (A) in FIG. 5 is "0", the counter 110 starts counting. The count value increases from a count start time (t=0) as shown in (I) of FIG. 5. For the certain period $t_s$ until the count value reaches a defined value $t_s$, the judgment processing circuit 111 judges whether or not a state in which the edge pulse $F_P$ is not set (a state of logic 0) continues as shown in (A) of FIG. 5.

In a case where the state in which the edge pulse $F_P$ is not set continues for the certain period $t_s$ (YES at step S2, YES at step S3), the judgment processing circuit 111 regards the state as silence to set the silence flag $F_S$ as shown in (C) of FIG. 5 (logic 1 results). In consequence, the time t of the counter 110 is reset to "0", and a series of judgment operations start (steps S4, S5).

In a case where the certain period $t_s$ does not elapse and the edge pulse $F_P$ is set before the silence flag $F_S$ is set, the counter 110 resets the time t to "0" (NO at step S2, step S5), and starts counting again. It is to be noted that, to prevent overflow, as shown in (I) of FIG. 5, a limiter value LM is set to the counter 110.

When the silence flag $F_S$ is set, the time t of the counter 110 has an increment from "0" (step S6). At this time, the silence flag $F_S$ indicates "1", the flag $F_1$ of the first clapping sound described later has a state of an initial value "0" (YES at step S7), and an input of the edge pulse $F_P$ based on the first clapping sound is waited.

When the edge pulse $F_P$ based on the first clapping sound is input as shown by 501 of FIG. 5(A), it is judged that the edge pulse $F_P$ is "1" (YES at step S8). The judgment processing circuit 111 sets the flag $F_1$ of the first clapping sound as shown in FIG. 5(D) (logic "1" is assumed) to judge the first clapping (step S9). The counter 110 sets the time t to "0" again (step S10), and the counter 110 starts counting again at rising of the edge pulse $F_P$ as shown in FIG. 5(I).

Subsequently, the silence flag $F_S$ and the flag $F_1$ indicate "1", the flag $F_2$ of the second clapping sound described later has a state of an initial value "0" (YES at step S11), and an input of the edge pulse $F_P$ based on the second clapping sound is waited. In a case where the edge pulse $F_P$ based on the second clapping sound is input as shown by 502 in (A) of FIG. 5 and it is judged that the edge pulse $F_P$ is "1" (YES at step S12), the judgment processing circuit 111 judges whether or not a rising time t of the edge pulse $F_P$ satisfies $t \geqq t_1$ and $t < t_1 + t_2$ (step S13).

That is, the judgment processing circuit 111 judges whether or not the rising time t of the edge pulse $F_P$ based on the second clapping sound falls in the gate 504 (a gate flag $F_G$) for the second clapping sound having the time width $t_2$ shown as (B) in FIG. 5. When the rising time falls in the gate 504, the flag $F_2$ of the second clapping sound is set as shown in (E) of FIG. 5 (step S14). Moreover, a value (the time) from the rising time of the edge pulse $F_P$ based on the second clapping sound to the rising time t of the edge pulse $F_P$ based on the second clapping sound is stored as an interval period $t_{IN}$ between the first clapping sound and the second clapping sound. The counter 110 resets the time t to t=0 to start counting again (step S15).

Subsequently, in a case where the silence flag $F_S$ and the flags $F_1$ and $F_2$ of the clapping sound of the first and second times indicate "1" the flag $F_3$ of the third clapping sound described later has a state of an initial value "0" (YES at step S16) and the edge pulse $F_P$ based on the third clapping sound is input as shown by 503 in (A) of FIG. 5, the judgment processing circuit 111 judges that the edge pulse $F_P$ is "1" (YES at step S17). Furthermore, it is judged whether or not the rising time t of the edge pulse $F_P$ based on the third clapping sound satisfies $t \geqq t_{IN} - (t_3/2)$ and $t < t_{IN} + (t_3/2)$ (step S18).

That is, the judgment processing circuit 111 judges whether or not the rising time t of the edge pulse $F_P$ based on the third clapping sound falls in the gate 505 (the gate flag $F_G$) for the third clapping sound having the time width $t_3$ smaller than the time width $t_2$ shown as (B) in FIG. 5. When the rising time falls in the gate 505, the flag $F_3$ Of the third clapping sound is set as shown in (F) of FIG. 5 (step S19). Furthermore, after the third clapping sound flag $F_3$ is set, the counter 110 resets to t=0 to start counting again (step S20). It is to be noted that the gate 505 for the third clapping sound is set so that the pulse rises after elapse of time obtained by subtracting time $t_3/2$ from the interval period $t_{IN}$ from a time when the edge pulse $F_P$ based on the second clapping sound rose.

At this time, all of the silence flag $F_S$ and the clapping sound flags $F_1$, $F_2$ and $F_3$ indicates logic "1", and a flag $F_4$ of the fourth clapping sound has a state of an initial value "0" (YES at step S21). In this state, the time t has an increment (NO at steps S22, S23, step S24). In a case where a state in which the edge pulse $F_P$ is not set continues until $t \geqq t_{IN} + (t_3/2)$ is satisfied, as shown in (G) of FIG. 5, the no-sound flag $F_N$ is set (YES at step S23, step S25).

The judgment processing circuit 111 sets the no-sound flag $F_N$, and determines that the input of the sound wave into the MC 101 has stopped.

Moreover, all of the silence flag $F_S$, the clapping sound flags $F_1$, $F_2$ and $F_3$ and the no-sound flag $F_N$ is set, and a judgment flag $F_J$ is output for an only certain period $t_F$ as shown in (H) of FIG. 5 in order to satisfy the constitution example of the present embodiment (step S26). Here, assuming that the clapping sound for the control is correctly input, a series of judgment operations are completed. After elapse of the certain period $t_F$, the judgment processing section 109 resets all the flags and the count value to "0", and the counter 110 starts counting again to prepare for the next judgment operation.

The judgment operation of the judgment processing section 109 according to the present embodiment has been described above.

It is to be noted that, in a case where a state in which the edge pulse $F_P$ (502) based on the second clapping sound is not input continues for a time $(t_1+t_2)$ (YES at step S27), the judgment processing section 109 judges input failure to reset the silence flag $F_S$, the interval period $t_{IN}$ and the first clapping sound flag $F_1$ (step S28).

Similarly, in a case where a state in which the edge pulse $F_P$ (503) based on the third clapping sound is not input continues for a time $t_{IN}+(t_3/2)$ (YES at step S29), the input failure is judged to reset the silence flag $F_S$, the interval period $t_{IN}$ and the clapping sound flags $F_1$, $F_2$ (step S30).

Moreover, after the flag $F_3$ of the third clapping sound is set, the edge pulse $F_P$ is input before the elapse of the time $t_{IN}+(t_3/2)$. In this case, the number of the clapping sounds is larger than the predetermined number. Therefore, the input failure is judged (YES at step S22, step S31).

According to the present embodiment, the interval period $t_{IN}$ from the time when the first edge pulse 501 corresponding to the first clapping sound is generated until the second edge pulse 502 corresponding to the second clapping sound is generated is reflected during the generation of the gate 505 to detect whether or not the third clapping sound has been generated. Therefore, the gate 505 for the third clapping sound is generated after the elapse of the time obtained by subtracting time of ½ of the time width $t_3$ of the gate 505 for the third clapping sound from the interval period $t_{IN}$ from the time when the second edge pulse 502 was generated.

Although not shown in FIG. 5, in a case where the number of the times to generate the clapping sound is set to four or more, one or a plurality of m (m is an integer of 3 or more and is 1 smaller than n) gates for the detection of fourth and n-th (n is an integer of 4 or more) clapping sounds may be generated in the same manner as in the gate 505 for the third clapping sound. The m gates are generated so that intervals between adjacent gates between the gate 505 for the third clapping sound and the m-th gate to detect whether or not the n-th clapping sound has been generated are a time obtained by subtracting, from the interval period $t_{IN}$, the time of ½ of the time width $t_3$ of the gate 505 for the third clapping sound.

As described above, since the interval period $t_{IN}$ is reflected during the generation of the gate to detect the third and subsequent clapping sounds, the gate for the third t gates can be regulatedclapping sound and the subsequen so that the adjacent gates (the gate flags $F_G$) for the clapping sounds are generated at equal intervals.

Moreover, in the present embodiment, since the time width $t_2$ of the gate 504 for the second clapping sound is set to be comparatively long, it is possible to cope with user's various clapping paces. Furthermore, since the interval period $t_{IN}$ is reflected, the time width $t_3$ of the gate for the third and subsequent clapping sounds can be set to be smaller than the time width $t_2$. The intervals at which the user generates the clapping sound can be judged by the interval period $t_{IN}$, and even the clapping sound having the smaller time width $t_3$ can sufficiently be detected. Since the time width $t_3$ can be reduced, an erroneous operation due to an unexpectedly emitted clapping sound, an irregularly incoming surrounding noise or the like can be reduced.

The judgment processing section 109 regards, as judgment conditions, the number of the edge pulses $F_P$ based on the series of sound waves picked up by the MC 101 and the generation intervals. Furthermore, in a case where more correct judgment is required, the ungenerated state (the silence flag $F_S$) of the sound wave before the generation of the series of the sound waves and the ungenerated state (the no-sound flag $F_N$) of the sound wave after the generation of the series of sound waves are regarded as the judgment conditions.

It is to be noted that judgment conditions including one of the silence flag $F_S$ and the no-sound flag $F_N$ or judgment conditions which do not include the flags may be used. In this case, the judgment operation of the judgment processing section 109 is facilitated.

However, in a case where the silence flag $F_S$ and the no-sound flag $F_N$ are used as the judgment conditions, when the user claps hands as much as the predetermined number of times, the judgment is performed as much as the predetermined number of the times+twice. A burden due to increase of the number of the claps is not imposed on the user, and erroneous judgment operations of the judgment processing section 109 are preferably reduced. Furthermore, the resistance to the sound generated at a surrounding area or the like is preferably improved as compared with a case where the other judgment conditions are used.

Paces at which persons easily clap hands are varied depending on the persons. For example, when a person claps hands at a comparatively slow pace, edge pulses $F_P$ are input at comparatively long intervals as shown by 701 to 703 in (A) of FIG. 7. In consequence, a gate flag $F_G$ (705) for the third clapping sound is generated as shown in (B) of FIG. 7. For example, when a person claps hands at a comparatively high pace, edge pulses $F_P$ are input at comparatively short intervals as shown by 708 to 710 in (C) of FIG. 7, and a gate flag $F_G$ (712) for the third clapping sound is generated as shown in (D) of FIG. 7.

Figure 7:
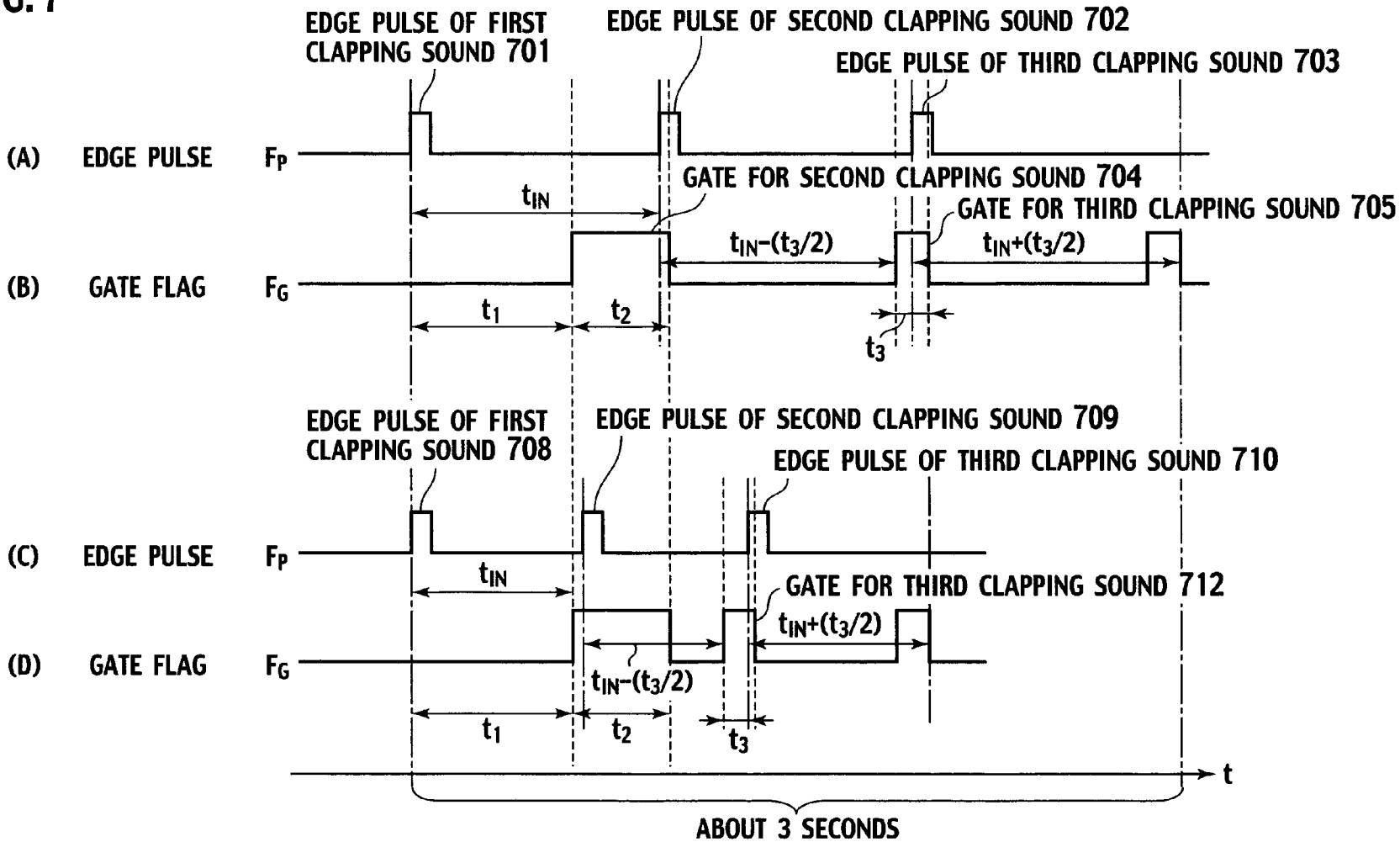
FIG. 7 is a diagram showing that the control method of the first embodiment of the present invention can cope with various clapping intervals.

In either of (A) and (C) of FIG. 7, the interval period $t_{IN}$ between the first clapping sound and the second clapping sound is reflected in a period from a time when the second edge pulse 702 or 709 corresponding to the second clapping sound is generated until the gate 705 or 712 for the third clapping sound rises. Therefore, according to the present embodiment, it is possible to cope with fluctuations of clapping intervals.

However, if any pace is accepted, the erroneous operation is caused. Therefore, a time from the first clap to the last clap may be set to a certain degree. Specifically, in a case where the clapping is performed three times as shown in FIG. 7, $t_1$ and $t_2$ may be set so that correct judgment can be performed, if the first to third claps are performed within about three seconds.

It is to be noted that, in the present embodiment, a case where control is performed in accordance with three claps, but the present invention is not limited to this embodiment. If the number of the claps is increased, the judgment conditions become severe as much as the increase, and the resistance to the erroneous operation improves.

However, if the number is set to be excessively large, the user feels troublesome, and failures increase. Therefore, it can be said that three to four claps is appropriate.

Moreover, in a case where the number of the claps is reduced to, for example, two, unlike a case where the number is set to three or more, an algorithm to reflect the interval period $t_{IN}$ cannot be applied. In this case, the resistance to the erroneous operation deteriorates. However, when silence states before and after the generation of the clapping sound are added to the judgment conditions described above, the judgment is performed 2+2 times. A much higher resistance can be obtained as compared with a case where the judgment is performed based on the two clapps only.

Figure 8:
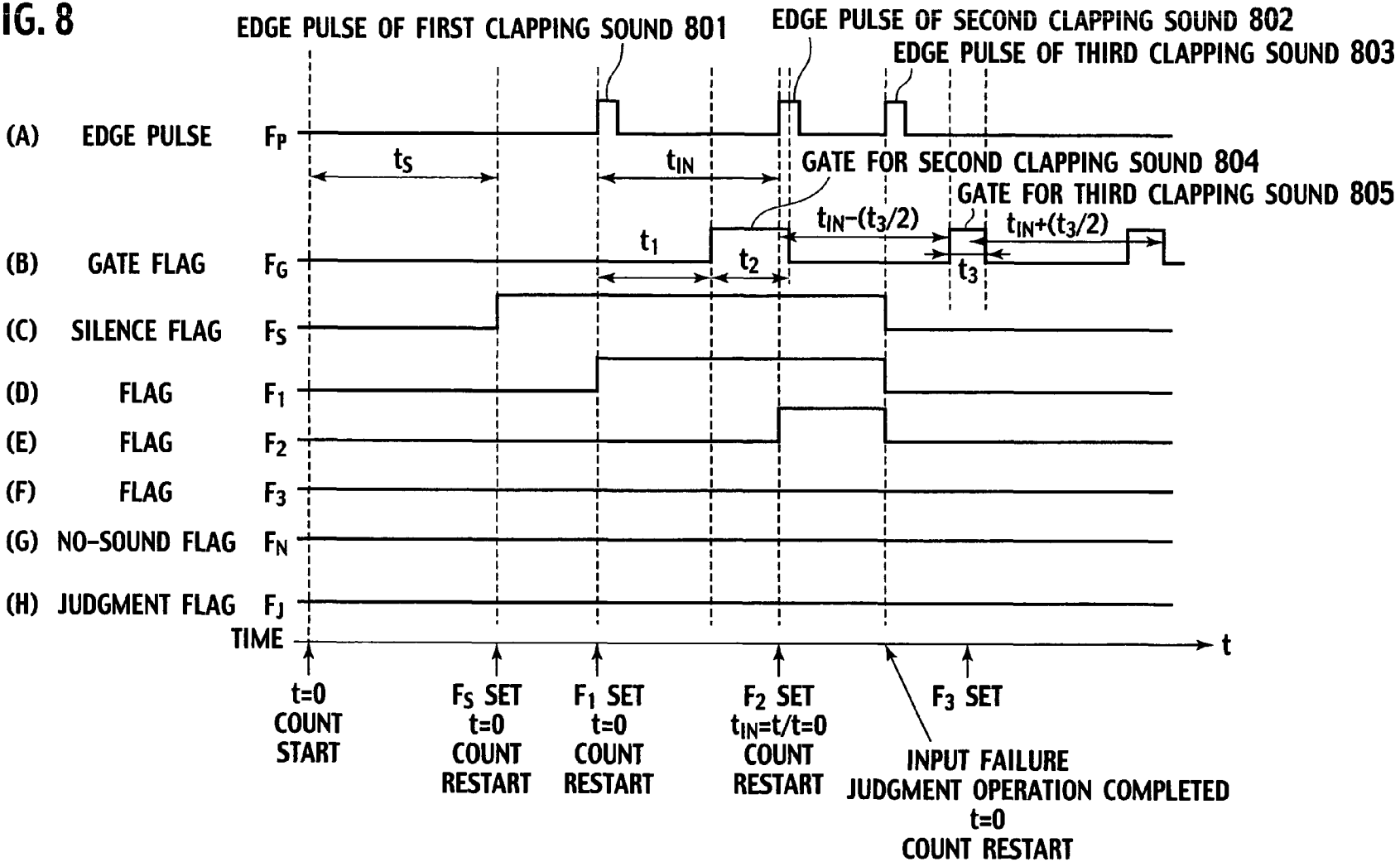
FIG. 8 is a diagram showing an example in which failure is judged in the control method according to the first embodiment of the present invention.

FIG. 8 shows a timing chart in a case where an edge pulse $F_P$ is generated at a period other than a period when a gate flag $F_G$ is set and input fails. The edge pulse $F_P$ based on the first clapping sound is generated as shown by 801 in (A) of FIG. 8, the gate flag $F_G$ for the second clapping sound is generated as shown by 804 in (B) of FIG. 8, and the edge pulse $F_P$ based on the second clapping sound is generated as shown by 802 in (A) of FIG. 8. As shown in (C), (D) and (E) of FIG. 8, a silence flag $F_S$, a flag $F_1$ and a flag $F_2$ are set.

The chart is the same as FIG. 5 up to this point, but the edge pulse $F_P$ based on the third clapping sound shown by 803 in (A) of FIG. 8 is generated outside a gate 805 for the third clapping sound shown as (B) in FIG. 8.

In this case, this sound is regarded as the unexpectedly emitted sound or the surrounding noise, the input fails, and a flag $F_3$ and a no-sound flag $F_N$ are not set as shown in (F) and (G) of FIG. 8. Therefore, the judgment operation ends, and any judgment flag $F_J$ is not output as shown in (H) of FIG. 8. In a case where the operation ends without outputting the judgment flag $F_J$, the judgment processing section 109 resets all the flags and the counter to 0 at this time, and the counter 110 starts counting the time t again to prepare for the next judgment operation start.

That is, in the present embodiment, in a case where the edge pulse $F_P$ is input even once outside the gate period, the input of the clap for the control is regarded as the failure. Therefore, the clapping sound can more correctly be detected.

Second Embodiment

Next, a second embodiment of the present invention will be described. In a case where clap control of the present invention is performed, when a large noise other than a clapping sound is present at a surrounding area, the clapping sound is buried in the surrounding noise and might not be detected. For example, in a case where music is listened at a high volume, when a sound similar to the clapping sound (in an amplitude value, a frequency band or the like) rings in the music, the sound is recognized as the clapping sound, and an erroneous operation might be caused.

Here, a state in which there is a possibility that inability to control an electronic appliance by claps or the erroneous operation is caused by such a surrounding sound other than the clapping sound will be referred to as a noise state.

Figure 9:
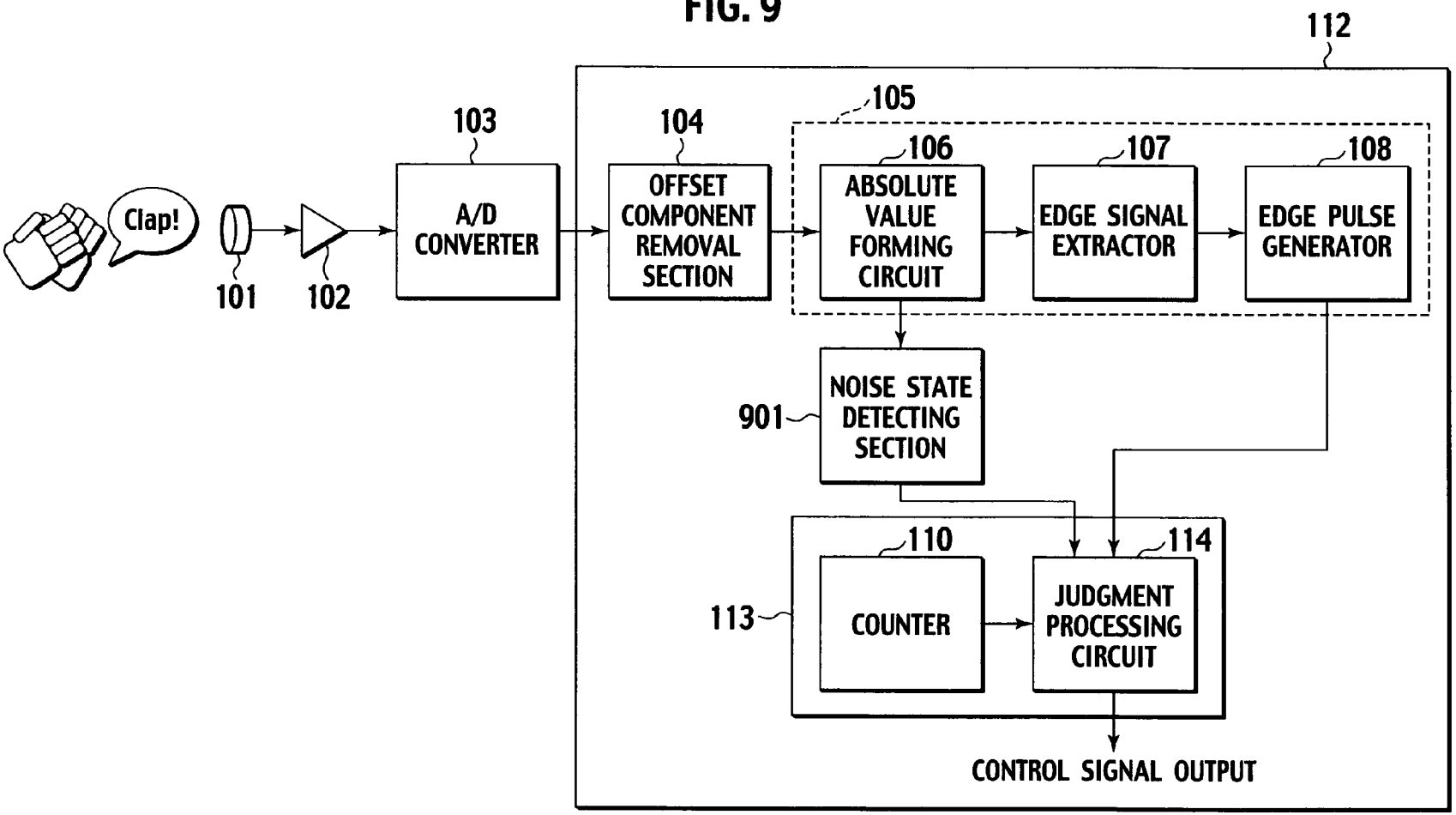
FIG. 9 is a block diagram of a second embodiment of the control device for the electronic appliance according to the present invention.

Here, the second embodiment is constituted so that, in a case where it is judged that a state is the noise state, the control by the claps is prohibited. FIG. 9 shows a block diagram of the second embodiment of a control device for the electronic appliance according to the present invention. In the drawing, the same constituting components as those of FIG. 1 are denoted with the same reference numerals, and description thereof is omitted.

In FIG. 9, a noise state detecting section 901 judges from an input waveform formed into an absolute value by an absolute value forming circuit 106 whether or not a continuous large sound other than the clapping sound is present at the surrounding area, and outputs a judgment result to a judgment processing section 113. The judgment processing section 113 includes a counter 110 and a judgment processing circuit 114, and judges the clap control based on a judgment result from the noise state detecting section 901 in addition to judgment similar to that of the judgment processing section 109 of the first embodiment.

Next, a detecting operation of the noise state detecting section 901 will be described also with reference to FIG. 10.

Figure 10:
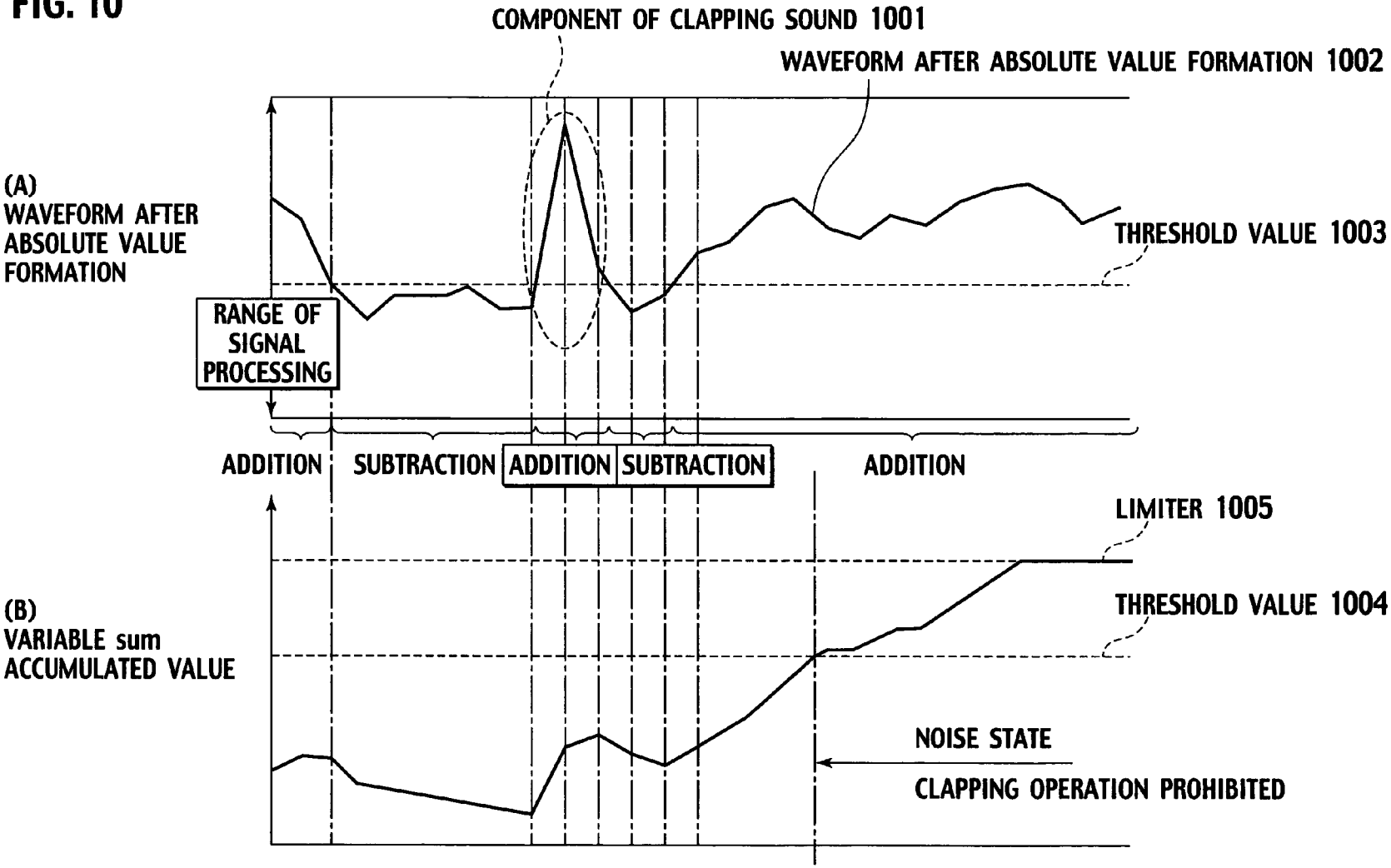
FIG. 10 is an explanatory view of a detecting operation of a noise state detecting section 901 of FIG. 9.

Waveform (A) of FIG. 10 shows a behavior of a waveform signal 1002 to be supplied to the noise state detecting section 901 after the absolute value formation in the noise state. A component 1001 of the clapping sound in the input waveform signal 1002 is buried in a component formed by the noise state, and it is difficult to detect the clapping sound component by the processing of the first embodiment.

To solve the problem, in the present embodiment, an appropriate threshold value 1003 is first set with respect to the waveform signal 1002. Moreover, the threshold value 1003 is subtracted from a value of the waveform signal 1002 to obtain a variable, and such variables are accumulated to obtain a variable sum. When the value of the waveform signal 1002 is less than the threshold value 1003, addition of a negative value, that is, subtraction from the variable sum is performed.

Since a value larger than the threshold value 1003 is input in a region shown as addition in (A) of FIG. 10, a difference between the value and the threshold value 1003 is added to the variable sum. Since the input value is smaller than the threshold value 1003 in a region shown as subtraction in the drawing, the difference is subtracted from the variable sum. The variable sum at this time is shown in (B) of FIG. 10.

Subsequently, an appropriate threshold value 1004 is provided even with respect to the variable sum. In a state in which the variable sum is larger than this threshold value 1004, the noise state detecting section 901 regards this state as the noise state, and outputs a clap control prohibition flag $F_F$ to the judgment processing section 113. Here, when the value of the waveform signal 1002 continues to exceed the threshold value 1003, the variable sum continues to be added. Therefore, to prevent overflow, a limiter 1005 is provided with respect to the variable sum as shown in (B) of FIG. 10. A lower limit value of the variable sum is set to 0.

When the clap control prohibition flag $F_F$ is not input, the judgment processing circuit 114 of the judgment processing section 113 performs a judgment operation similar to that of the judgment processing circuit 111 of the first embodiment. On the other hand, when the clap control prohibition flag $F_F$ is input, a judgment operation is stopped to prohibit the clap control. In consequence, the erroneous operation due to the surrounding noise is prevented. When the clap control prohibition flag $F_F$ is set, a predetermined display may be displayed in a screen or a predetermined voice may be generated from a speaker so that a user can recognize a state in which the clap control is not accepted.

When the value of the waveform signal 1002 is level-sliced to perform judgment, the clap control prohibition flag $F_F$ is set by the clapping sound itself, because the component of the clapping sound has a large amplitude during rising. However, the judgment is performed using the variable sum which is an accumulated value of the values of the waveform signal 1002, instead of the value of the waveform signal 1002, as in the present embodiment. In consequence, the clap control prohibition flag $F_F$ can be set with respect to continuous large surrounding sounds only.

Since the clap control prohibition flag $F_F$ is introduced as described above, it is possible to prevent the erroneous operation in a case where the continuous large noise exists as shown in (A) of FIG. 10. Furthermore, with the display or the like by which the user can recognize the prohibited state, the user does not have to clap hands uselessly in a state in which the clap control cannot be performed. Moreover, if, for example, the music is a cause of the noise, a countermeasure can be taken, for example, the music is stopped.

The clap control prohibition flag $F_F$ of the second embodiment can be introduced by adding the noise state detecting section 901 to the first embodiment. The clapping sound control can be performed with less erroneous operations as compared with the first embodiment.

Third Embodiment, Fourth Embodiment

Next, third and fourth embodiments of the present invention will be described. It can be said that the edge signal extractor 107 of the first embodiment separates a noise which is a low-frequency component from a clapping sound which is a high-frequency component by use of a low pass filter (LPF), but the third and fourth embodiments are constituted so that an input sound is divided into a plurality of frequency bands, and a necessary component and an unnecessary component are further distinguished from each other.

Since the clapping sound indicates an impulse waveform, the sound has signal components over almost all of the frequency bands. When the input sound is divided into a plurality of bands with a pass filter by use of this characteristic and the sounds are subjected to clapping sound detection processing as in the first embodiment, the clapping sound can be distinguished from another sound such as a sound which exists in an only specific band. When the number of the divided bands increases, precision of the distinction improves. Here, the simplest example to divide the band into two bands is shown in FIGS. 11A and 11B.

Figure 11A:
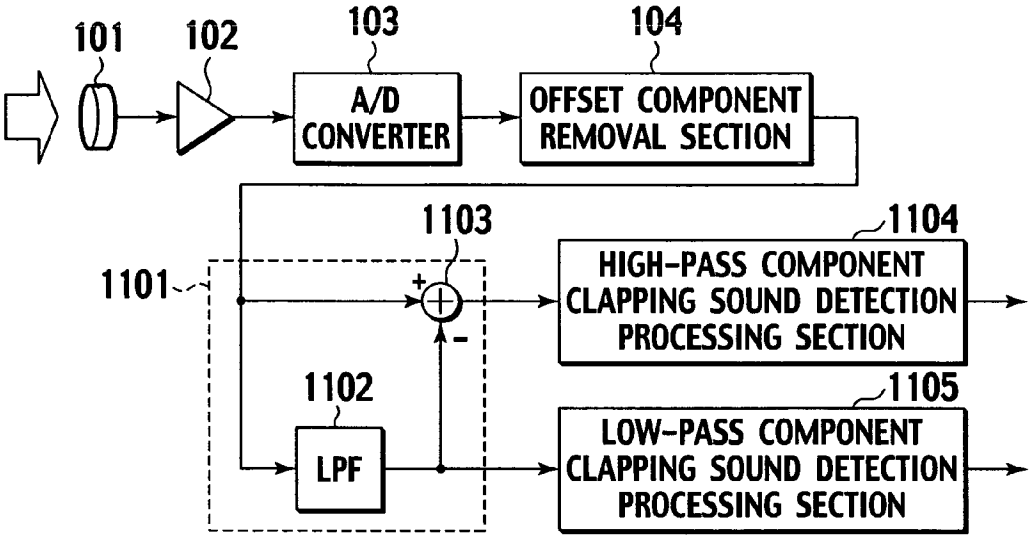
FIGS. 11A and 11B are block diagrams of main parts of third and fourth embodiments of the control device for the electronic appliance according to the present invention.
Figure 11B:
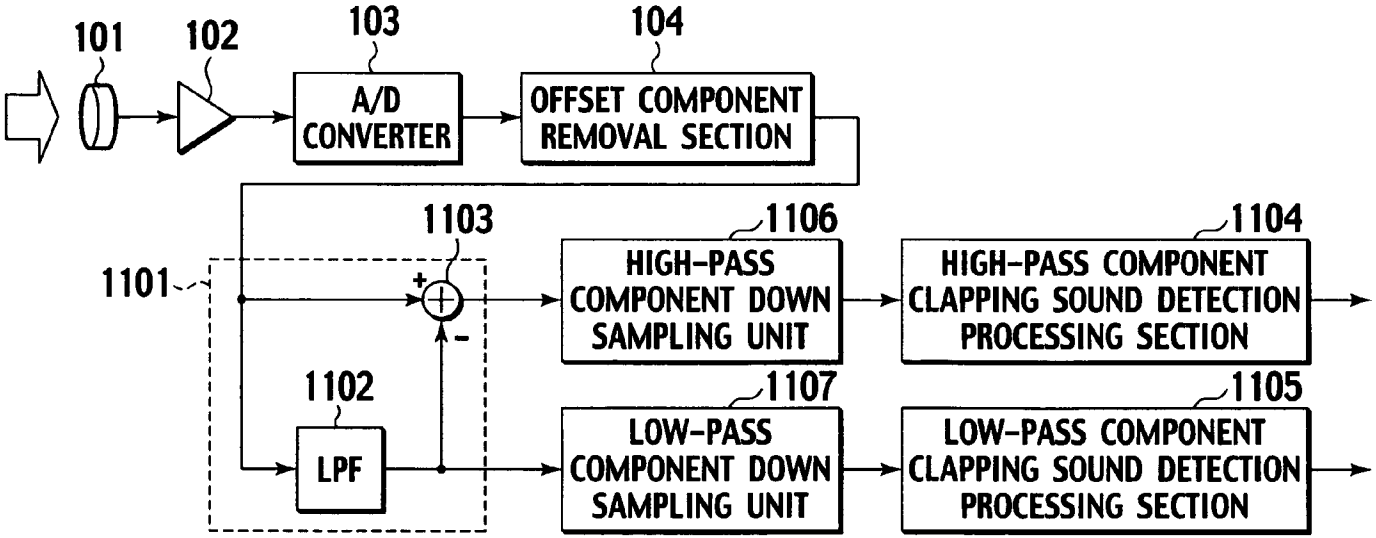

FIG. 11A shows a block diagram of a main part of the third embodiment of the control device for the electronic appliance according to the present invention, and FIG. 11B shows a block diagram of a main part of the fourth embodiment of the control device for the electronic appliance according to the present invention. In the drawings, the same constituting components as those of FIG. 1 are denoted with the same reference numerals, and description thereof is omitted. As shown in FIGS. 11A and 11B, the third and fourth embodiments have the same constitution as that of the first embodiment up to an offset component removal section 104, but a constitution different from that of the first embodiment is formed by disposing circuit blocks which start with a band division processing section 1101 at a subsequent stage of the offset component removal section.

Figure 12A:
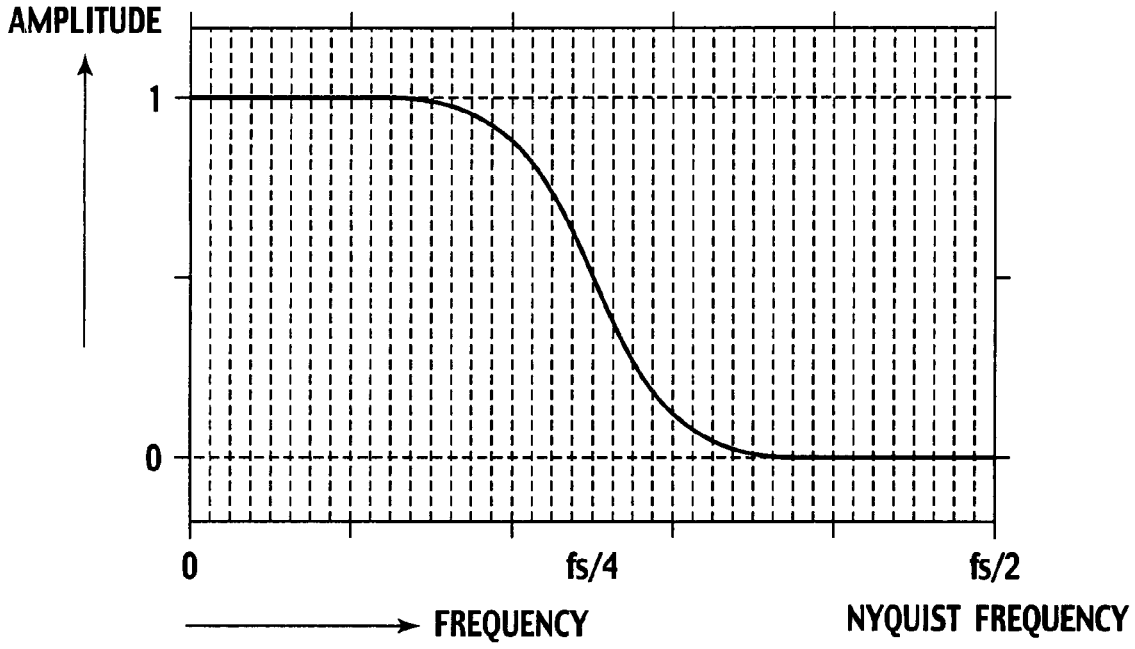
FIGS. 12A and 12B are diagrams showing a frequency characteristic and an impulse response (a tap coefficient) of an LPF shown in FIGS. 11A and 11B.
Figure 12B:
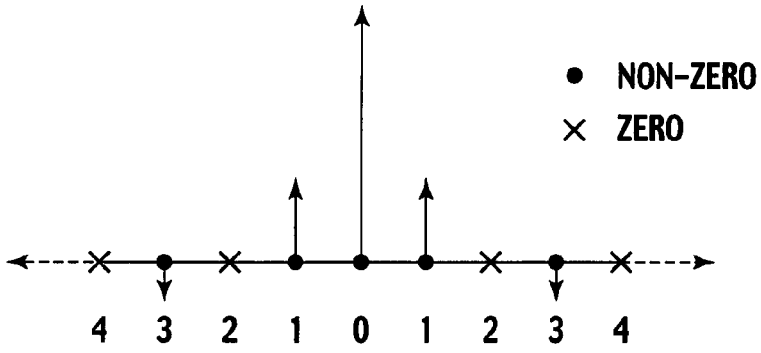

In FIGS. 11A and 11B, the band division processing section 1101 includes a low pass filter (LPF) 1102 and a subtracter 1103. FIG. 12A shows a frequency characteristic of the LPF 1102, and FIG. 12B shows an impulse response (a tap coefficient).

It is preferable that the frequency characteristic of the LPF 1102 shown in FIG. 12A has a characteristic that a transition band of the frequency is steep to a certain degree and has little ringing in consideration of detection of rising of an edge based on the clapping sound at a subsequent stage of the LPF 1102. It is preferable that the LPF 1102 is a filter system in which the tap coefficient is as small as possible in order to reduce power consumption and complete processing within a sampling period.

Here, an example is shown in which a satisfactory operation and reduction of a circuit scale are achieved using a maximum flat half band finite impulse response (FIR) filter. In this type of filter, a tap coefficient of an even order except the center tap is zero. In FIG. 12B, odd taps shown by black circles are non-zero, and even taps shown by x are zero. The tap coefficient of the center tap of the LPF 1102 is ½. Therefore, signals can be processed with bit shift.

When the control of the electronic appliance according to the present embodiment is used in turning on power supply or the like, the control device is functioned at a time when the power supply is on standby. Therefore, the filter system in which simple processing is performed preferably has a small circuit scale and small power consumption.

As shown in FIG. 12A, a filter characteristic of the maximum flat half band FIR filter has point symmetry around an amplitude of 0.5 at a frequency of ¼ of a sampling frequency fs. This means that energy of an original signal is equally divided during filter processing. There is an advantage that the signal can equally be evaluated by the subsequent edge detecting section and judgment processing.

The LPF 1102 shown in FIGS. 11A and 11B takes and outputs a low-pass frequency component (hereinafter referred to as the low-pass component) of a signal from which an offset component is removed by the offset component removal section 104.

The subtracter 1103 subtracts the low-pass component output from the LPF 1102 from the signal having the offset component removed therefrom and output from the offset component removal section 104. Therefore, the subtracter 1103 outputs a high-pass frequency component (hereinafter referred to as the high-pass component) obtained by decaying the low-pass component of the signal from which the offset component has been removed, that is, the high-pass component provided with a high-pass filter characteristic.

In the third embodiment shown in FIG. 11A, a signal of the high-pass component output from the band division processing section 1101 is supplied to a high-pass component clapping sound detection processing section 1104, and a signal of the low-pass component is supplied to a low-pass component clapping sound detection processing section 1105. Each of the processing sections 1104, 1105 detects the clapping sound by a circuit similar to the clapping sound detection processing section 105 of FIG. 2, and outputs an edge pulse to the judgment processing section 109 or 113.

The high-pass component clapping sound detection processing section 1104 and the low-pass component clapping sound detection processing section 1105 process an input voice signal without changing a rate at which the signal has been sampled by an A/D converter 103. Here, a sampling frequency of the A/D converter 103 is fs. Therefore, the high-pass component clapping sound detection processing section 1104 generates a high-pass edge pulse $F_{PH}$ based on the high-pass component having the sampling frequency fs, and the low-pass component clapping sound detection processing section 1105 generates a low-pass edge pulse $F_{PL}$ based on the low-pass component of the sampling frequency fs.

The fourth embodiment shown in FIG. 11B is obtained by adding a high-pass component down sampling unit 1106 and a low-pass component down sampling unit 1107 to the third embodiment. A signal of a high-pass component output from a band division processing section 1101 is supplied to the high-pass component down sampling unit 1106, and a signal of a low-pass component is supplied to the low-pass component down sampling unit 1107.

The high-pass component down sampling unit 1106 and the low-pass component down sampling unit 1107 reduce the sampling rate of the signal obtained by dividing a frequency band in accordance with the number of the divided bands to lengthen a period for the subsequent processing, and the signal is provided with a time allowance required for the processing. Moreover, in order to reduce power of a frequency division system, the sampling frequency fs of an A/D converter 103 is converted into a sampling frequency (a sub-sampling frequency fs') obtained by dividing the frequency by the number of the divided bands, for example, two. According to a known sampling theorem, the sampling frequency fs is a frequency which is twice or more as large as the maximum frequency of the input voice signal of the A/D converter 103.

The high-pass component down sampling unit 1106 and the low-pass component down sampling unit 1107 reduce the sampling frequency to a Nyquist rate (½)fs in a case where the signal is sampled by the A/D converter 103 to obtain a sampling rate for the subsequent processing. This is so-called sub-Nyquist sampling processing.

Examples of a method of reducing the sampling rate to ½ at the high-pass component down sampling unit 1106 and the low-pass component down sampling unit 1107 include an in-phase down-sampling method of both of the high-pass component and the low-pass component and a down-sampling method which differs in a reversed phase (180 degrees). The method in the reversed phase is preferable, because a signal having a different phase is included in one of the high-pass and low-pass components.

The high-pass component signal down-sampled from the sampling rate fs to (½)fs by the high-pass component down sampling unit 1106 is supplied to the high-pass component clapping sound detection processing section 1104. Moreover, the low-pass component signal down-sampled from the sampling rate fs to (½)fs by the low-pass component down sampling unit 1107 is supplied to the low-pass component clapping sound detection processing section 1105.

The high-pass component clapping sound detection processing section 1104 generates a high-pass edge pulse $F_{PH}'$ based on the high-pass component of the sampling frequency (½)fs, and the low-pass component clapping sound detection processing section 1105 generates a low-pass edge pulse $F_{PL}'$ based on the low-pass component of the sampling frequency (½)fs.

Diagrams (A) to (D) of FIG. 13 show frequency spectra of the signals of the main parts of FIGS. 11A and 11B in a case where the frequency band is divided into two bands of the low and high bands. Among the signal components band-divided by the band division processing section 1101 at the sampling frequency fs, the low-pass component indicates a spectrum S1 of (A) of FIG. 13, and the high-pass component indicates a spectrum S3 shown in (C) of FIG. 13. When the sampling rate of the high-pass component S3 is reduced to ½ by the high-pass component down sampling unit 1106 and the sampling rate of the low-pass component S1 is reduced to ½ by the low-pass component down sampling unit 1107, the signal of the low-pass component indicates a signal spectrum S1', S2 of (B) of FIG. 13, and the high-pass component indicates a signal spectrum S3', S4 of (D) of FIG. 13.

As described above, the filter processing of the band division processing section 1101 functions as a prefilter of sub-sampling, and the sampling rate can be reduced to ½ without being influenced by a return component.

Next, handing of the high-pass edge pulse $F_{PH}$ obtained by the high-pass component clapping sound detection processing section 1104 and the low-pass edge pulse $F_{PL}$ obtained by the low-pass component clapping sound detection processing section 1105 in a judgment processing section 109 will be described. This is shown in FIG. 14.

As edge pulses to be handled here, the edge pulses $F_{PH}$ and $F_{PL}$ at the sampling frequency fs will be described. However, the pulses may be the edge pulses $F_{PH}'$ and $F_{PL}'$ at the sampling frequency (½)fs. Evaluations of the obtained edge pulses will be described.

FIG. 14 shows one example of evaluation in a case where an electronic appliance is controlled by clapping hands three times, "○" indicates a case where each edge pulse is detected in a gate period, and "×" indicates a case where any edge pulse is not detected.

In the example of FIG. 14, the high-pass edge pulse $F_{PH}$ based on the second clap cannot be detected, but the low-pass edge pulses $F_{PL}$ based on all claps can be detected. Here, in a method of the evaluation, the first clap is regarded as start. To avoid erroneous detection is regarded as important, and a logical product of both of the high-pass edge pulse $F_{PH}$ and the low-pass edge pulse $F_{PL}$ is calculated as a calculation result of the first clap.

On the other hand, a logical sum of the high-pass edge pulse $F_{PH}$ and the low-pass edge pulse $F_{PL}$ is taken to calculate the calculation result of the second clap and the third clap. Moreover, in first evaluation, it is confirmed that the calculation result of the edge pulses based on first to third clapping sounds exists. In second evaluation, sum of the number of times of detection of the edge pulses $F_{PH}$, $F_{PL}$ during the second and third clap is evaluated. When the edge pulses $F_{PH}$ and $F_{PL}$ are completely detected, the number of the detection times is four. Here, to improve recognition ratio, if the number of the detection times is three or more, recognition is determined. Such processing is performed to improve a resistance to erroneous recognition.

For example, an electronic sound or the like referred to as a beep sound, for example, a warning sound of the electronic appliance or the like has a specific frequency component. Therefore, for example, when the beep sound is repeated three times, the edge pulse is detected and cannot be distinguished in the same manner as in the clapping. Even when such a case is assumed, according to the evaluation method of FIG. 14, the logical product is obtained as described above once among all of the three claps. Therefore, both of the high-pass edge pulse $F_{PH}$ and the low-pass edge pulse $F_{PL}$ need to rise simultaneously, and the erroneous recognition of an electronic sound such as the beep sound can be avoided. Since an electronic sound such as the beep sound has a specific frequency component, both of the high-pass edge pulse $F_{PH}$ and the low-pass edge pulse $F_{PL}$ do not rise simultaneously.

It is to be noted that the method of the evaluation is not limited to the method shown in FIG. 14, and severe evaluation may be performed so that a calculation content of all the claps is the logical product of the high-pass edge pulse $F_{PH}$ and the low-pass edge pulse $F_{PL}$.

Moreover, assuming that the calculation content of all the claps is the logical sum of the high-pass edge pulse $F_{PH}$ and the low-pass edge pulse $F_{PL}$, the sum of the detection times of the edge pulses may be evaluated. It is preferable that a purpose of improving precision of the detection or the resistance to the erroneous recognition is set in accordance with environments.

Fifth Embodiment

Next, a fifth embodiment of the present invention will be described. In the first embodiment, a control method (a judgment processing algorithm) of a judgment processing section 109 to judge the only predetermined number of claps (three claps in the first embodiment) has been described. However, if the judgment can be performed with respect to the only predetermined number of the claps, only one type of control can be performed, when the control of an electronic appliance by this clapping sound is actually performed and even if the control is varied in accordance with a state of the electronic appliance. This is a large restriction on the use of the present invention.

When the several types of the number of the claps are distinguished and a control operation can be set in accordance with the number of the claps, the use is broadened. Therefore, in the present embodiment, a control method to judge several types of the number of the claps will be described.

Figures 15, 16:
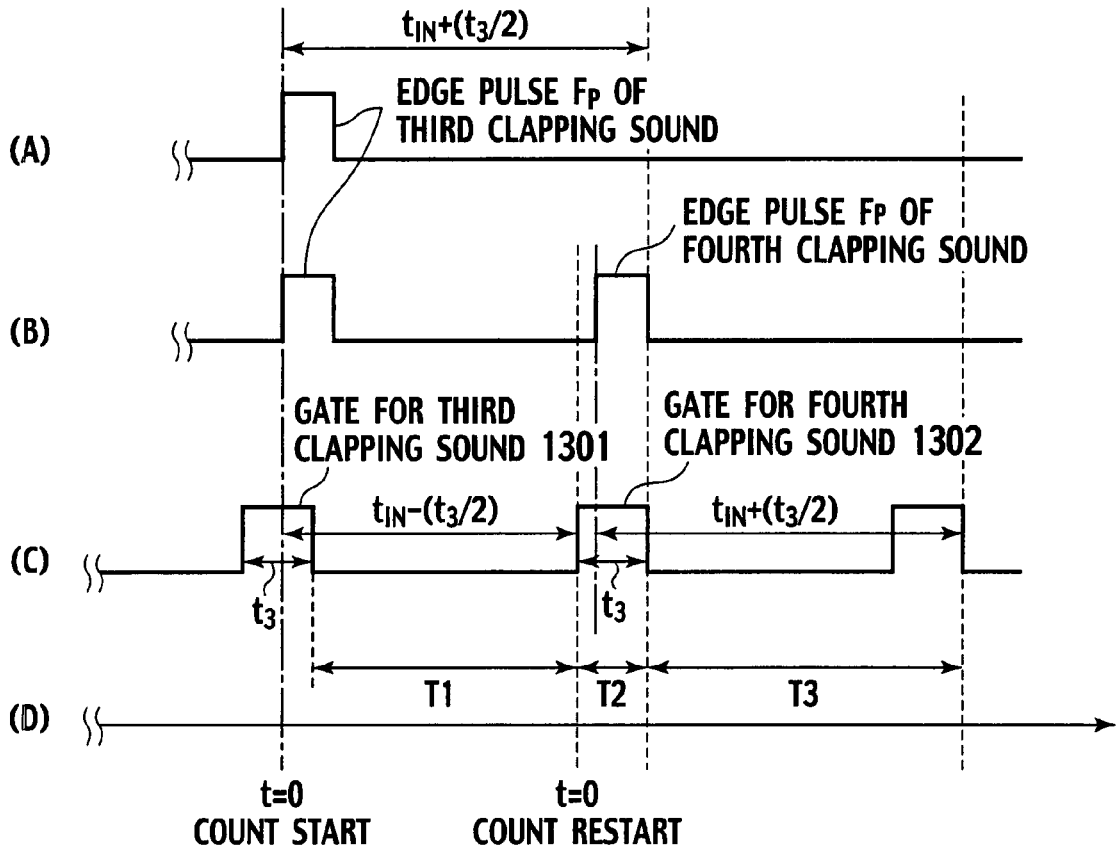
FIG. 15 is a timing chart explaining a control method according to a fifth embodiment of the present invention.
FIG. 16 is an explanatory view showing judgment conditions according to the fifth embodiment of the present invention.

FIG. 15 shows a control method to judge three claps and four claps as one example of the present embodiment. Diagram (A) of FIG. 15 shows edge pulses $F_P$ in a case where the electronic appliance is controlled with the three claps, and diagram (B) of FIG. 15 shows edge pulses $F_P$ in a case where the apparatus is controlled with the four claps. The control method in a state in which input of the third clap is completed, that is, in a state in which a silence flag $F_S$ and clapping sound flags $F_1$ to $F_3$ shown in FIG. 5 are set is the same as that of the first embodiment. Therefore, description and drawing thereof are omitted. An operation of the judgment processing section 109 (or 113) after output of the edge pulse Fp based on the third clapping sound will be described.

As shown in (A) of FIG. 15, when a judgment processing circuit 111 detects the edge pulse $F_P$ based on the third clapping sound in a gate 1301 of the third clapping sound shown in (C) of FIG. 15, a counter 110 starts counting again at t=0. Subsequently, when any edge pulse $F_P$ is not generated within a period of T1 and T2 ($t<t_{IN}+(t_3/2)$) shown in (C) of FIG. 15 and $t \geqq t_{IN}+(t_3/2)$ is satisfied, the above-mentioned judgment conditions of the three claps are satisfied, and the input becomes successful. This has been described in the first embodiment.

On the other hand, in a case where the edge pulse $F_P$ is detected within the period of T1 and T2 ($t<t_{IN}+(t_3/2)$) of (C) of FIG. 15, a condition that any edge pulse $F_P$ is not detected for a predetermined period after the third clap is not satisfied. Therefore, the control by three claps fails.

In a case where the clapping is performed four times as shown in (B) of FIG. 15, when the edge pulse $F_P$ based on the third clapping sound is detected in the gate 1301 of the third clapping sound shown in (C) of FIG. 15 in the same manner as in (A) of FIG. 15, the counter 110 starts counting again at t=0. Subsequently, the judgment processing circuit 111 generates a gate 1302 to detect whether or not the fourth clapping sound has been generated, after elapse of a predetermined time $t_{IN}-(t_3/2)$ from the time t when the edge pulse $F_P$ based on the third clapping sound is generated by an edge pulse generator 108.

Here, a case where the edge pulse $F_P$ based on the fourth clapping sound is generated in a period of T1 to T3 shown in (C) of FIG. 15 will be described.

First, when the edge pulse $F_P$ based on the fourth clapping sound is generated in a period T1 ($t<t_{IN}-(t_3/2)$) outside the gate 1302, the control by four claps fails.

In a case where the edge pulse $F_P$ based on the fourth clapping sound is generated in a period T2 which satisfies $t \geqq t_{IN}-(t_3/2)$ and $t<t_{IN}+(t_3/2)$ within the gate 1302, the judgment processing circuit 111 detects that a sound wave based on the fourth clapping sound has been generated. It is confirmed that any edge pulse $F_P$ is not generated until a period T3 of $t_{IN}+(t_3/2)$ elapses from the time t when the edge pulse $F_P$ based on the fourth clapping sound is generated, judgment conditions of the four claps are satisfied, and the control by the four claps becomes successful.

It is to be noted that, even when the edge pulse $F_P$ based on the fourth clapping sound is generated in the period T3 outside the gate 1302, the control by the four claps fails. The period of $t_{IN}+(t_3/2)$ has already elapsed from the time t when the edge pulse $F_P$ based on the third clapping sound was generated. Therefore, even if the fourth sound wave is input, the sound wave is not recognized.

In a case where it is set that the electronic appliance is controlled by three or four claps as in this example, the judgment conditions of the third clap are satisfied as described above, the control is judged to be performed by the three claps.

As described above, the judgment conditions of the three clapping sounds and four clapping sounds have been considered separately. The judgment conditions are summarized as shown in FIG. 16. In FIG. 16, "○" indicates that the edge pulse $F_P$ is set once in the period, "x" indicates that the edge pulse $F_P$ is not set even once in the period, and "–" indicates that there is not any relation.

In a case where the edge pulse $F_P$ is set in the period T1, the case does not agree with either of the judgment conditions for the three claps and the four claps. Therefore, input failure results. When any edge pulse $F_P$ is not set in the period T2, it is judged that three claps have been made. When the edge pulse $F_P$ is set in the period T2, there is not any possibility that the three claps have been made.

Furthermore, in a case where the edge pulse $F_P$ is set in the period T2 and the edge pulse $F_P$ is not set in the period T3, it is judged that four claps have been made.

When the above-mentioned judgment operation is realized, the three claps can be distinguished from the four claps. Since this judgment method does not theoretically limit the number of the claps and the type of the number of the claps, the method can broadly be applied. That is, it is possible to distinguish three or more types of the number of the claps.

Sixth Embodiment

As the number of claps increases, it is seen that a user's clapping pace tends to increase little by little. In this case, in first to fifth embodiments in which gates to detect third and subsequent clapping sounds are disposed at equal interval periods, even when a user intends to correctly clap hands at equal intervals, there is a possibility that clapping is not judged as intended by the user.

Figure 17:
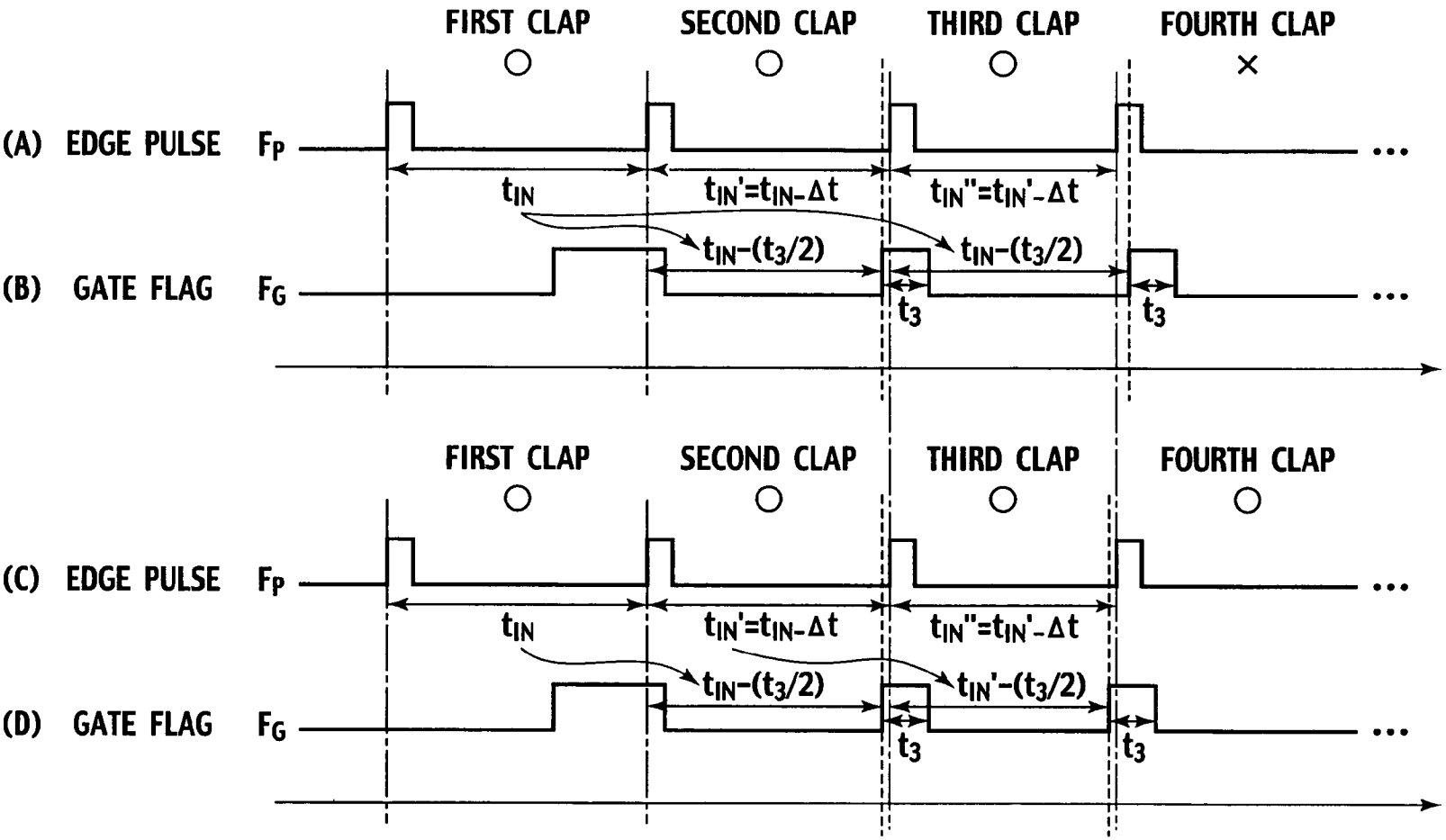
FIG. 17 is a timing chart showing a sixth embodiment of the present invention.

FIG. 17 shows a case where the clapping pace increases. Edge pulses $F_P$ shown in (A), (C) of FIG. 17 indicate that an interval period $t_{IN}$ between a first clap and a second clap and an interval period $t_{IN}'$ between the second clap and a third clap has a relation of $t_{IN}'=t_{IN}-\Delta t$. Similarly, the interval period $t_{IN}'$ between the second clap and the third clap and an interval period $t_{IN}''$ between the third clap and a fourth clap has a relation $t_{IN}''=t_{IN}'-\Delta t$. It is indicated that the interval period is shorter than the previous interval period as much as a small period $\Delta t$.

As shown in (B) of FIG. 17, in a case where a gate flag $F_G$ to uniformly reflect the interval period $t_{IN}$ between the first clap and the second clap in all gate periods is generated with respect to an clapping input having such a gradually shortening interval period, deviation gradually occurs between the clap and the gate period. In examples of (A), (B) of FIG. 17, the user intends to clap hands at equal intervals, but the fourth clap deviates from the gate period, and input failure results.

To solve the problem, in the present embodiment, the interval period $t_{IN}$ between the first clap and the second clap is not uniformly reflected in all gate periods. As shown in (D) of FIG. 17, it is assumed that the gate flags $F_G$ in which the previous interval periods are reflected are generated.

In consequence, as shown in (C) of FIG. 17, it is possible to cope with even a case where the interval period between the claps gradually shortens.

Seventh Embodiment

Figure 18:
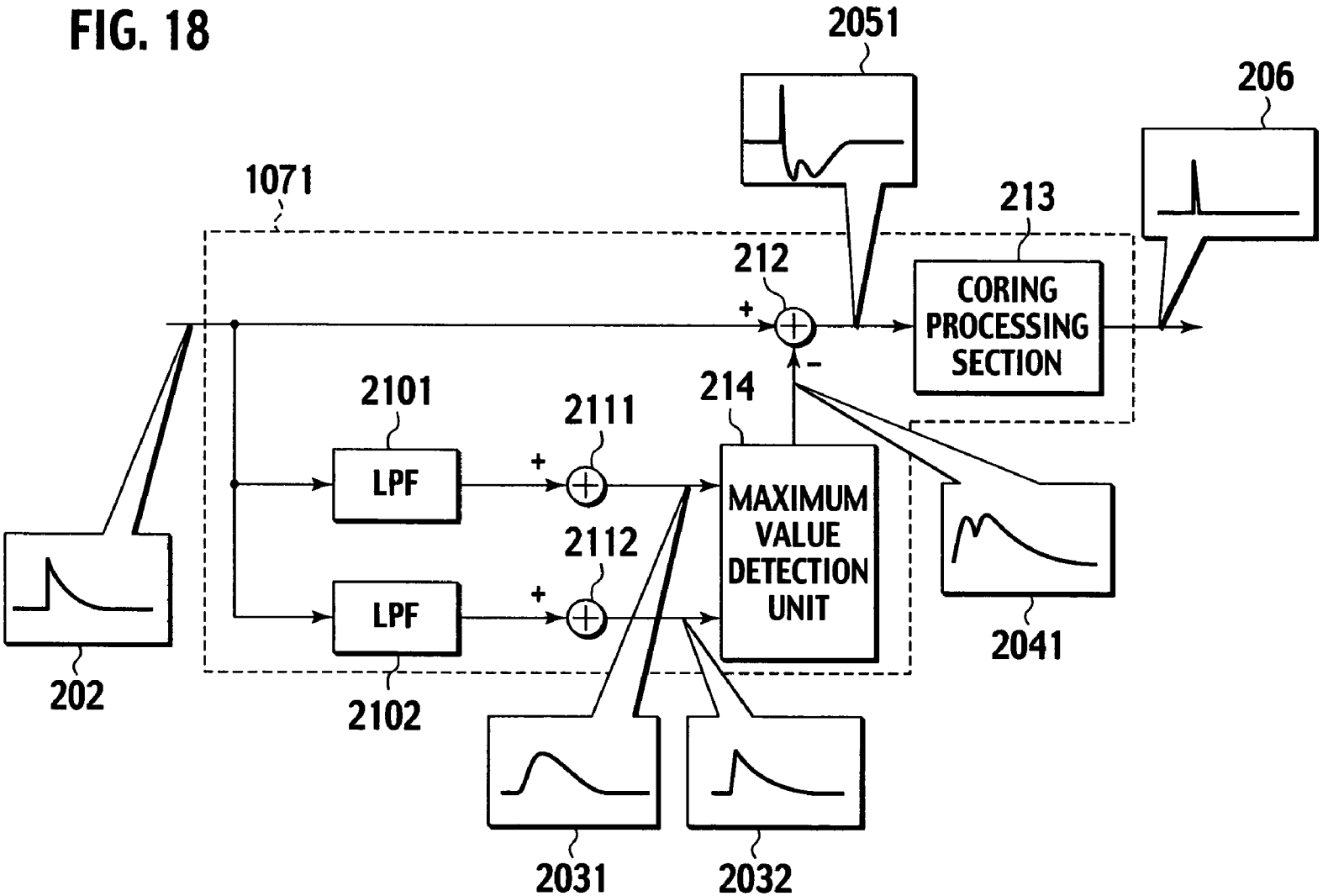
FIG. 18 is a block diagram of a seventh embodiment of the present invention.

A clapping sound is variously echoed, depending on an environment where an electronic appliance is disposed. In the sixth embodiment, it is constituted that a control device is not influenced by the environment. Furthermore, the constitution is realized by adding a few circuits to an edge signal extractor 107. FIG. 18 shows a block diagram of a seventh embodiment. In the drawing, the same constituting parts as those of FIG. 2 are denoted with the same reference numerals, and description thereof is omitted.

The seventh embodiment is provided with an edge signal extractor 1071 shown in FIG. 18, instead of the edge signal extractor 107 of the first embodiment shown in FIG. 2.

The edge signal extractor 1071 of the seventh embodiment includes LPFs 2101, 2102, multipliers 2111, 2112, a maximum value detection unit 214, a subtracter 212 and a coring processing section 213.

The LPFs 2101, 2102 decay high-frequency components of a waveform signal 202 output from an absolute value forming circuit 106 to generate waveform signals. The waveform signals output from the LPF 2101 are multiplied by the multiplier 2111 to form a waveform signal 2031. The waveform signals output from the LPF 2102 are multiplied by the multiplier 2112 to form a waveform signal 2032.

The waveform signals 2031, 2032 are input into the maximum value detection unit 214. The maximum value detection unit 214 detects larger data from sampling data of the input waveform signals to generate a waveform signal 2041. The subtracter 212 subtracts the waveform signal 2041 from the waveform signal 202 to output a waveform signal 2051. The coring processing section 213 subjects the waveform signal 2051 to coring processing to set a value to "0" in a case where the value is smaller than a certain threshold value to generate a waveform signal 206.

In the present embodiment, an LPF characteristic of the LPF 2101 is set on a low-pass side, and an LPF characteristic of the LPF 2102 is set on an intermediate-pass side from the LPF characteristic of the LPF 2101. In consequence, even in a case where the clapping sound is echoed in different manners, depending on the environment where the electronic appliance is disposed, the clapping sound can correctly be recognized.

SPECIFIC EXAMPLES

As specific examples in which an electronic appliance is controlled by a clapping sound according to each embodiment of the present invention described above, FIG. 19 shows one example in which a television receiver (hereinafter referred to as the television) is controlled. In the drawing, the same constituting parts as those of FIGS. 1, 2, 9 and 11 are denoted with the same reference numerals.

Figure 19:
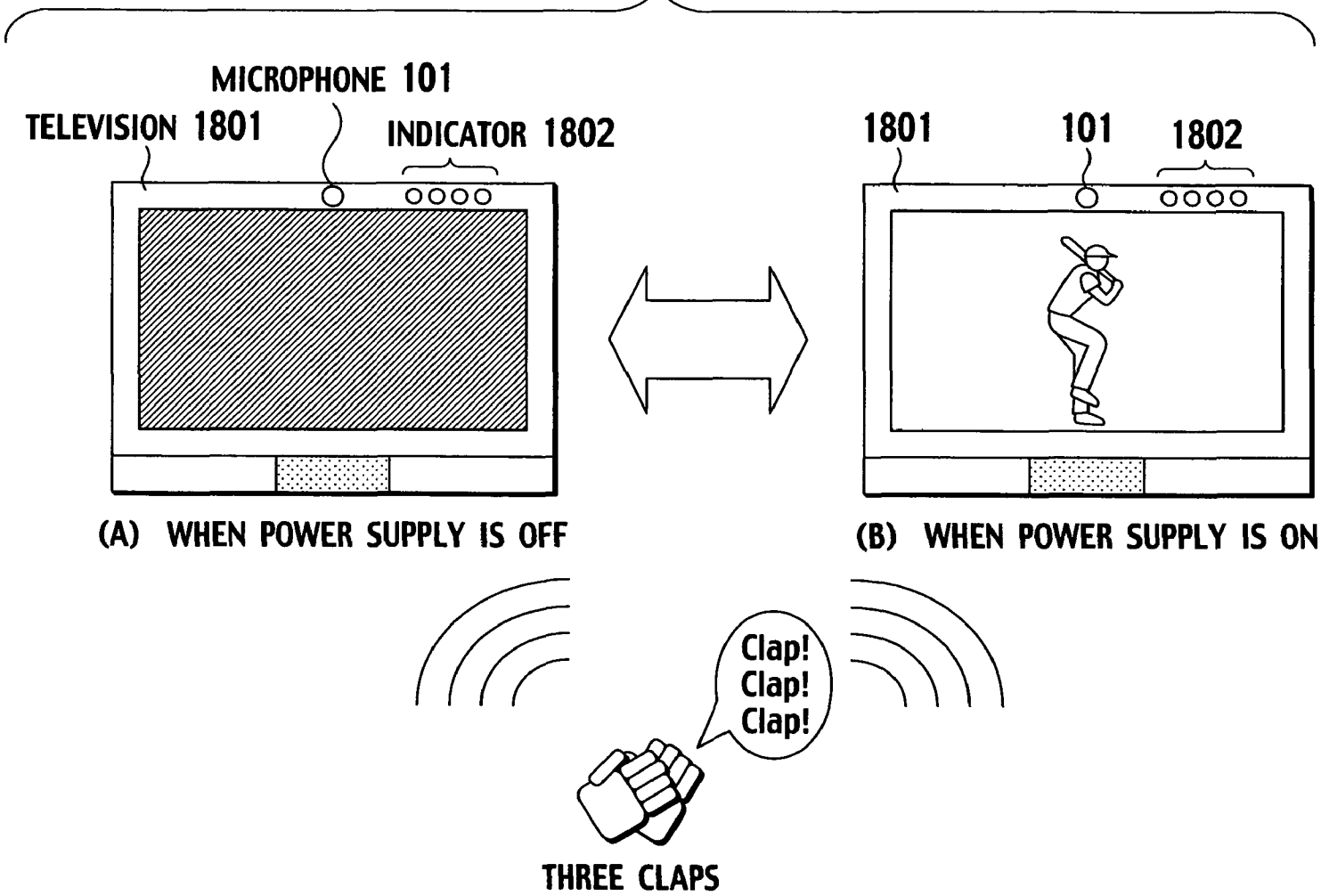
FIG. 19 is an explanatory view of a specific example in which power supply of television is turned on/off according to the present invention.

Diagram (A) of FIG. 19 shows a television 1801 at a time when power supply turns off, and diagram (B) of FIG. 19 shows the television at a time when the power supply turns on. A microphone 101 is disposed at an upper portion of a front surface of the television 1801, and indicators 1802 including a plurality of light emitting diodes (LED) having different emitted colors are disposed adjacent to the microphone.

It is preferable to install the microphone 101 at a position where the clapping sound can be picked up well. The microphone may be installed at the center of the upper portion of the television 1801 as shown in (A) and (B) of FIG. 19, or may be installed at another place. However, there is a possibility that an erroneous operation occurs or clap control is obstructed owing to a sound from a speaker disposed at the television 1801. Therefore, it is preferable to dispose the microphone at a place which is distant from the speaker and where the sound output from the speaker is not picked as much as possible.

The indicators 1802 indicate a state of the sound input from the microphone 101 at present with respect to a user. For example, as described above, to start judgment, a silence flag $F_S$ needs to be set. In a noise state, the clap control prohibition flag $F_F$ is set, and the control by the clapping sound is prohibited. Since the states of these flags are directly concerned with the control, the user needs to recognize the states, and the indicators 1802 which allow the user to recognize the states are required.

Here, as one example, in a case where the silence flag $F_S$ is set, an LED of the indicators 1802 which emits orange light is driven. In a case where the clap control prohibition flag $F_F$ is set, an LED of the indicators 1802 which emits red light is driven. In consequence, in a case where the orange LED does not emit the light, the user sees that a silence period is insufficient. When the red LED emits the light, the user recognizes the noise state. Therefore, it is prevented that the user uselessly claps hands and feels stressful.

Moreover, when an edge pulse $F_P$ is set, an LED of the indicators 1802 which emits yellow light is driven. When a judgment flag Fj is set, an LED of the indicators 1802 which emits green light is driven. In consequence, the user can see by the emitted color of the LED whether or not the present clap is detected and whether or not the judgment has become successful, and control can be realized without any stress.

It is to be noted that, in this example, an example where the indicators 1802 include four LEDs which emit the light of different colors has been described. However, the number of the indicators, the colors, a display method and the like are not limited to this example, and may have any configuration as long as it is easily recognized by the user.

Moreover, in a case where the control by the three claps is assigned to a time when the power supply is turned on and a time when the power supply is turned off, when the three claps are detected and the judgment flag $F_J$ is output, a signal equivalent to a remote control code output at a time when a power supply button of the remote controller is pressed may be transmitted to a control section of a television main body to realize the control. At this time, the control with the remote controller can be prevented from being performed, and the electronic appliance may be controlled by the only clapping sound. The remote control and the control by the clapping sound may be used together. In the latter case, a logical sum of a signal from the remote controller and a signal due to the clapping sound may be taken.

In this example, in a case where the user claps hands three times at a time when the power supply is turned off as shown in (A) of FIG. 19, the state is changed to a power supply on-state shown in (B) of FIG. 19. In a case where the user claps hands three times in a state in which the power supply is turned on as shown in (B) of FIG. 19, the state is changed to a power supply off-state shown in (A) of FIG. 19.

Moreover, usually in the electronic appliance, when the power supply is turned off, a microcomputer disposed in the apparatus is brought into a state referred to as a standby state or a stop mode. As compared with a usual operation, a clock frequency is reduced, or supply of clock is stopped. It is difficult to perform the processing described above in the embodiments by software in this state. For example, all the processing needs to be performed by hardware, and a signal needs to be input as an interruption signal into the microcomputer.

Figure 20:
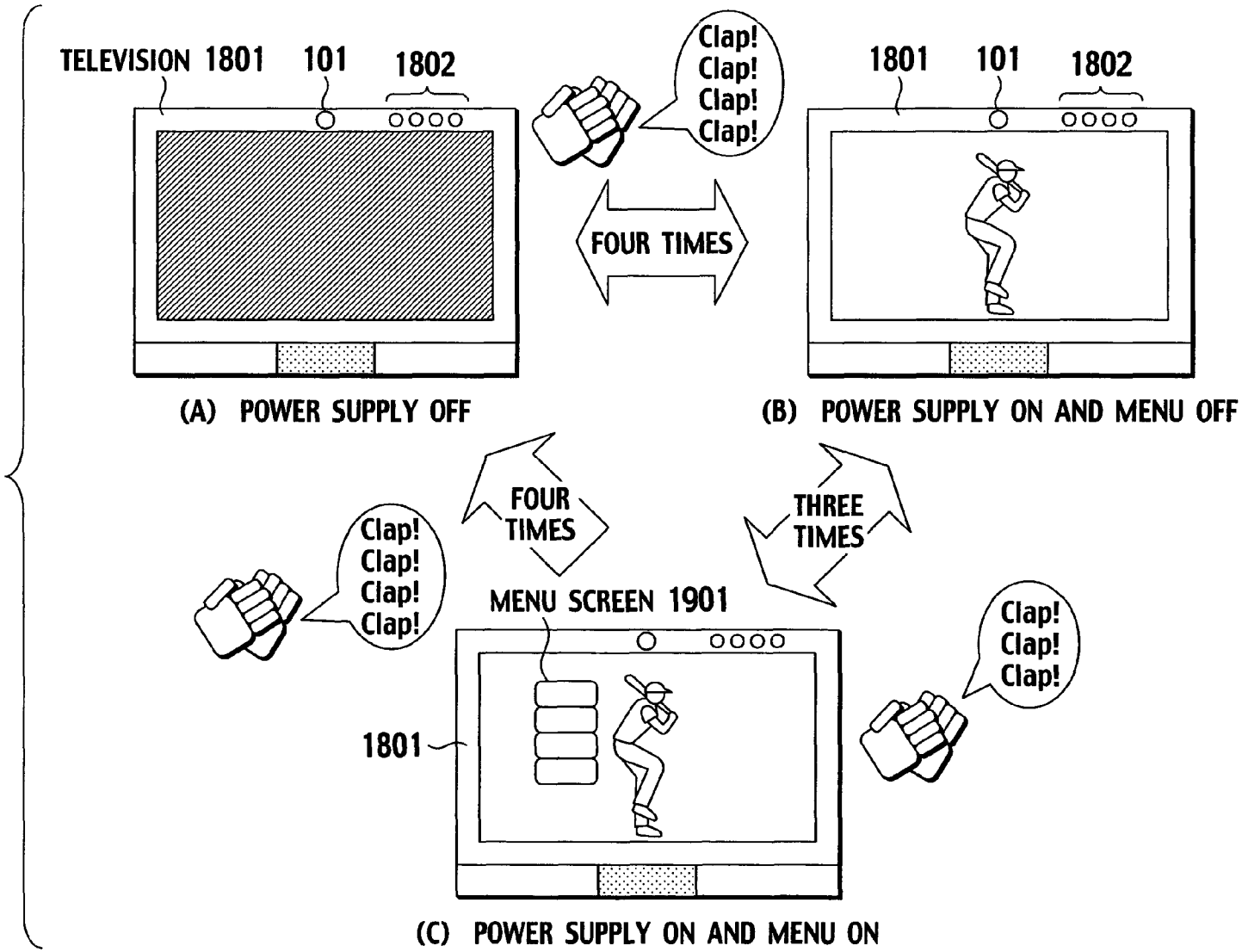
FIG. 20 is an explanatory view of a specific example in which television is controlled in different manners according to the present invention.

FIG. 20 shows an example of a case where the different numbers of the claps are assigned to separate control operations with respect to the control of the television 1801. In the drawing, the same constituting parts as those of FIG. 19 are denoted with the same reference numerals, and description thereof is omitted. In this example, four claps are assigned to the turning on/off of the power supply, and three claps are assigned to turning on/off of a menu screen 1901.

In a case where the user claps hands four times in a state in which the power supply of the television 1801 is turned off as shown in (A) of FIG. 20, a state shifts to a state in which the power supply is turned on as shown in (B) of FIG. 20.

Moreover, in a case where the user claps hands four times in a state in which the power supply of the television 1801 is turned on as shown in (B) of FIG. 20, the state shifts to the state in which the power supply of the television 1801 is turned off as shown in (A) of FIG. 20. In a case where the user claps hands three times, the state shifts to a state in which the menu screen is turned on as shown in (C) of FIG. 20. In a case where the user claps hands three times in a state in which the menu screen is turned on as shown in (C) of FIG. 20, the state shifts to a state in which the menu screen is turned off as shown in (B) of FIG. 20.

Furthermore, in a case where the user claps hands four times in the state in which the menu screen is turned on as shown in (C) of FIG. 20, the state shifts to the state in which the power supply of the television 1801 is turned off as shown in (A) of FIG. 20. In consequence, a plurality of control operations set in accordance with the number of the clapping sounds are performed with respect to one electronic appliance (the television 1801 here).

Figure 21:
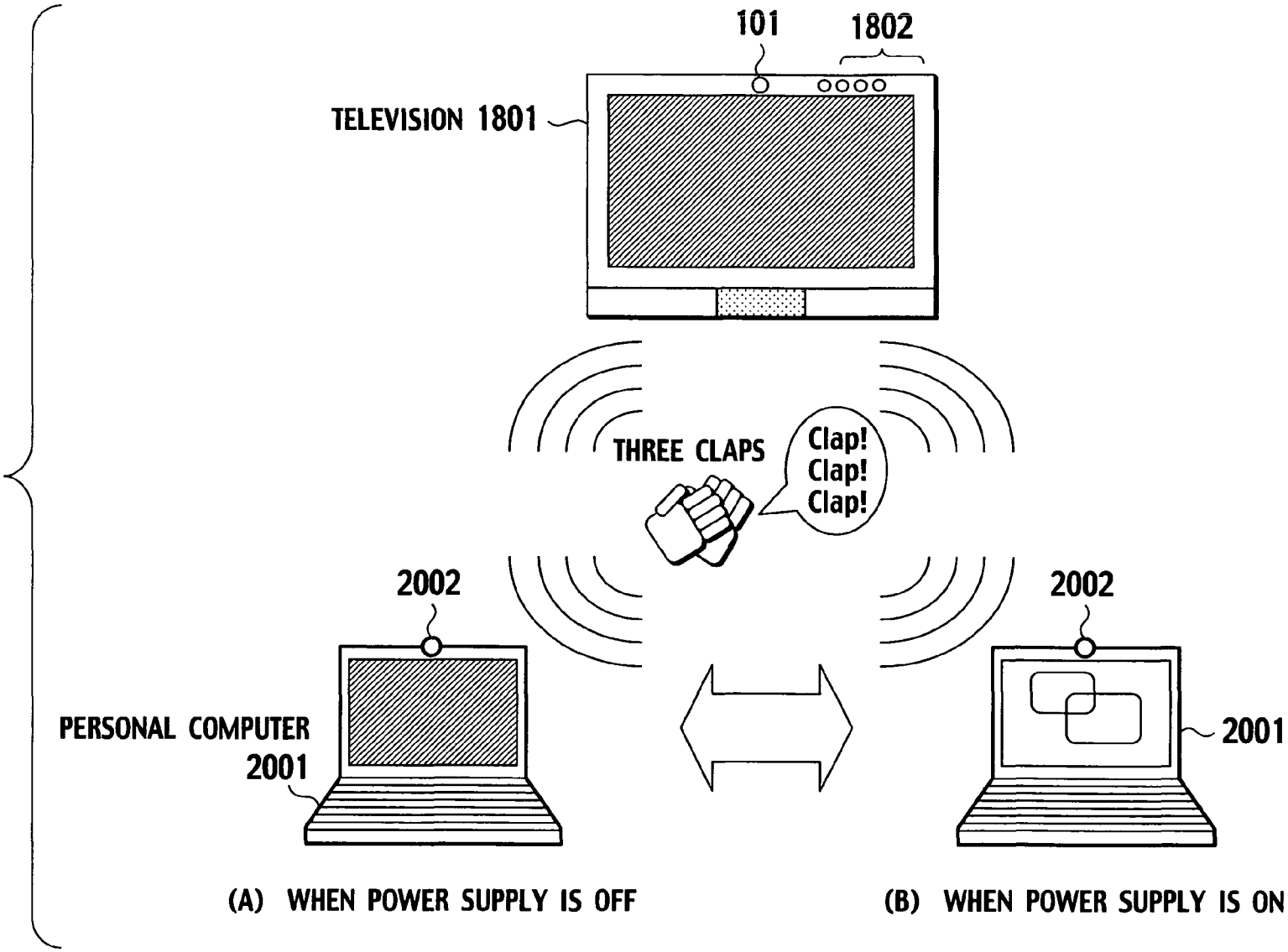
FIG. 21 is an explanatory view of a first example in which two electronic appliances are selectively controlled according to the present invention.
Figure 22:
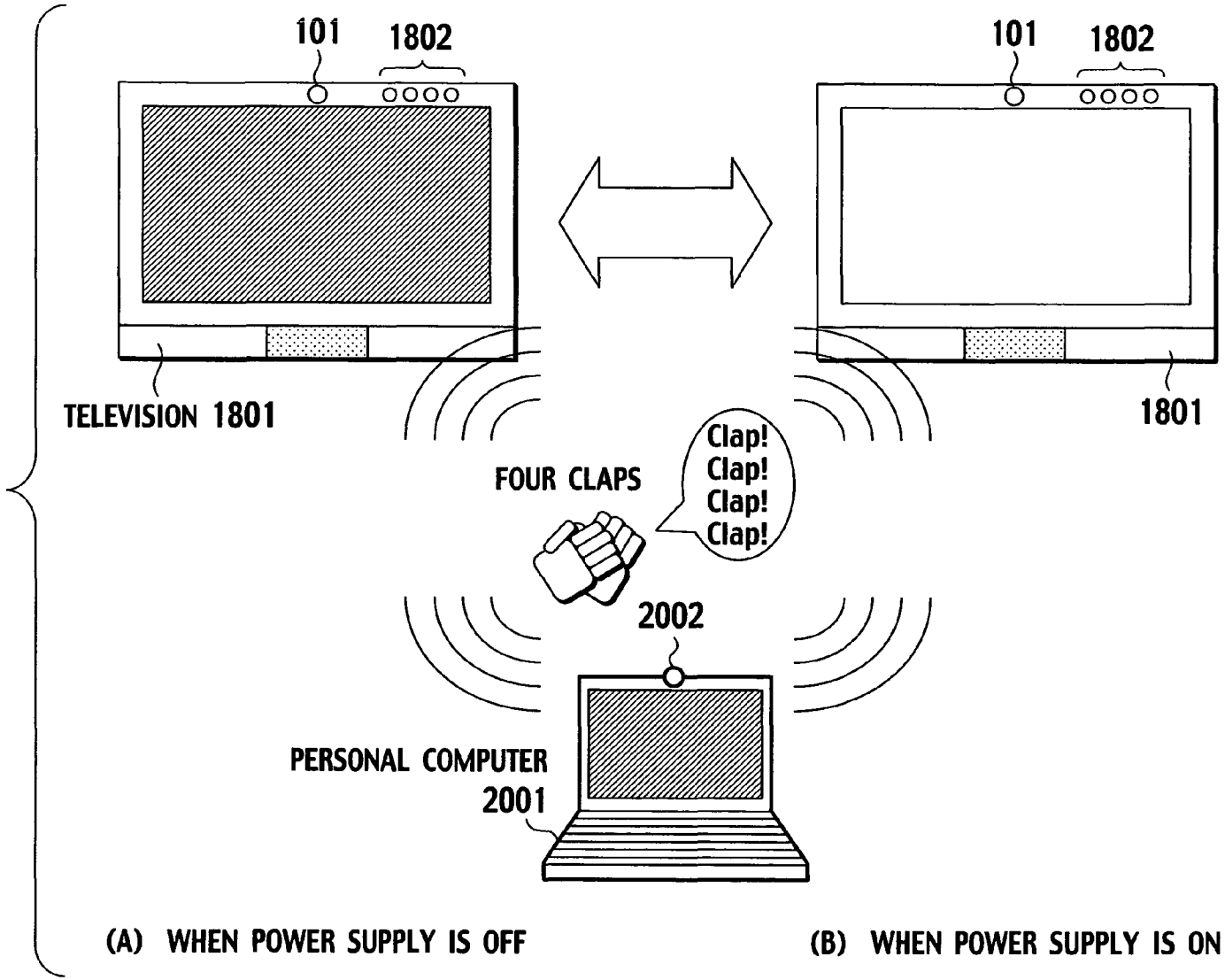
FIG. 22 is an explanatory view of a second example in which two electronic appliances are selectively controlled according to the present invention.

In addition, unlike the above example, a plurality of control operations of electronic appliances are set in accordance with the number of the clapping sounds, and the apparatuses can be controlled individually. FIGS. 21 and 22 show one example. In the drawings, the same constituting parts are denoted with the same reference numerals. FIG. 21 shows an example in which three claps are assigned to control for turning on/off of a power supply of a personal computer 2001 among different electronic appliances such as a television 1801 and the personal computer 2001.

It is to be noted that the personal computer 2001 is provided with a microphone 2002 corresponding to the above-mentioned microphone 101 so that a clapping sound can be detected.

Moreover, FIG. 22 shows an example in which four claps are assigned to control of turning on/off of the power supply of the television 1801 in the television 1801 and the personal computer 2001. In this example, the power supply of the television 1801 is turned on/off by the four claps, and the power supply of the personal computer 2001 is turned on/off by the three claps.

The television 1801 does not respond to the three claps, and the personal computer 2001 does not respond to the four claps. Therefore, the claps can selectively be used. It is to be noted that the example of the control of two electronic appliances is shown here, but there is not any restriction on the number of the electronic appliances which can be controlled and the types of the electronic appliances.

In addition, the first to seventh embodiments described above are not exclusive. Therefore, the first embodiment may be used as a base, and desired embodiments may be incorporated in the base. However, in a case where the control device is actually used in households, a resistance to an erroneous operation needs to be increased as much as possible. When functions of all the embodiments are incorporated, the best function can be obtained.

From the above-mentioned embodiments, the highly practical control of the electronic appliance due to the clapping sound can be realized. When the sound input into the microphone is evaluated and judged in accordance with the frequency band, the amplitude, the time region and the sound emitting pattern, the control include features that (1) the control has a high resistance to obstruction due to the noise and the irregularly incoming sound to prevent the erroneous operation; (2) since the user may clap hands as much as the predetermined number of times and the clapping pace is not limited, various users easily use the control; and (3) since there is not any restriction on the number of the claps and the type of the number of the claps which can be judged, various types of control can be assigned to one electronic appliance in accordance with the number of the claps, and different electronic appliances can selectively be controlled.

It is to be noted that, in the above first to the seventh embodiments, the judgment of three or more claps has been described, but the electronic appliance can be controlled even by one clap or two claps. However, three or less claps simply have the small number of the judgment times. In addition, the control method of reflecting the interval period between the first clap and the second clap in the next interval period as described in the first embodiment cannot be applied. Therefore, the erroneous operation largely increases as compared with three or more claps. Therefore, it can be said that the realistic number of the claps is three or more as described above in the embodiments.

Moreover, in the above embodiments, the case where the electronic appliance is controlled in accordance with the claps generated by the user (the operator) has been described, but the present invention is not limited to this case. The user may generate the predetermined number of sound waves for the control of the electronic appliance, and a sound wave generation method other than the claps (e.g., a hit sound emitted at a time when the user hits a desk or the like at the closest position with a hand-held object, etc.) is also included in the present invention.

More generally, it should be understood that many modifications and adaptations of the invention will become apparent to those skilled in the art and it is intended to encompass such obvious modifications and changes in the scope of the claims appended hereto.

What is claimed is:

1. A control device for an electronic appliance, comprising:

a sound detector which detects a series of sound waves generated at predetermined time intervals for control of the electronic appliance to perform sound-electricity conversion;

an edge signal extractor which generates edge signals in response to generation timings of the individual sound waves in the series of sound waves based on a voice signal output from the sound detector;

an edge pulse generator which generates edge pulses based on the edge signals; and a judgment processing circuit which generates a first gate having a first time width to detect whether or not a second sound wave of the series of sound waves has been generated after elapse of a first predetermined time from a first time when a first edge pulse is generated, when the sound detector detects a first sound wave of the series of sound waves in an ungenerated state of the series of sound waves and the edge pulse generator generates the first edge pulse corresponding to the first sound wave, and which generates a second gate having a second time width smaller than the first time width to detect whether or not a third sound wave of the series of sound waves has been generated after elapse of a second predetermined time from a second time when a second edge pulse is generated, when the edge pulse generator generates the second edge pulse corresponding to the second sound wave within the first gate.

2. The control device for the electronic appliance according to claim 1, wherein the second predetermined time is a time obtained by subtracting a time of ½ of the second time width from a time between the first time and the second time.

3. The control device for the electronic appliance according to claim 1, wherein the judgment processing circuit generates one or a plurality of m-th gates (m is an integer of 3 or more and is smaller than n by 1) to detect whether or not one or a plurality of n-th sound waves (n is an integer of 4 or more) which are fourth and subsequent sound waves of the series of sound waves have been generated, and generates the m-th gates so that intervals between adjacent gates between the second gate and the m-th gate are the second predetermined time.

4. The control device for the electronic appliance according to claim 1, wherein the judgment processing circuit generates one or a plurality of m-th gates (m is an integer of 3 or more and is smaller than n by 1) to detect whether or not one or a plurality of n-th sound waves (n is an integer of 4 or more) which are fourth and subsequent sound waves of the series of sound waves have been generated, and generates the m-th gates so that intervals between adjacent gates between the second gate and the m-th gate are successively shortened.

5. The control device for the electronic appliance according to claim 4, wherein after the edge pulse generator generates a third edge pulse corresponding to the third sound wave, the judgment processing circuit generates the m-th gates at a timing obtained by reducing a predetermined error time from an interval between an n−1-th edge pulse corresponding to an n−1-th sound wave and an n−2-th edge pulse corresponding to an n−2-th sound wave.

6. The control device for the electronic appliance according to claim 1, wherein when the judgment processing circuit does not detect the second and subsequent sound waves within the gates to detect the respective sound waves, the judgment processing circuit generates a no-sound flag indicating that input of the sound wave into the sound detector has stopped to determine that the input of the sound wave into the sound detector has stopped, and the judgment processing circuit generates a control signal indicating a preset control operation with respect to the number of the detected edge pulses.

7. The control device for the electronic appliance according to claim 1, further comprising:

a band division processing section which divides the voice signal output from the sound detector into a plurality of frequency bands and which outputs the voice signals of the plurality of divided frequency bands to the edge signal extractor, respectively, wherein the edge signal extractor generates the plurality of edge signals based on the voice signals of the plurality of frequency bands, and the edge pulse generator generates the plurality of edge pulses based on the plurality of edge signals.

8. A control method of an electronic appliance, comprising:

a sound detecting step of detecting a sound wave generated for control of the electronic appliance;

a sound-electricity conversion step of subjecting the sound wave to sound-electricity conversion to output a voice signal;

an edge signal generation step of generating an edge signal in response to a generation timing of the sound wave based on the voice signal;

an edge pulse generation step of generating an edge pulse based on the edge signal;

a first gate generation step of generating a first gate having a first time width to detect whether or not a second sound wave of a series of sound waves has been generated after elapse of a second predetermined time from a first time when a first edge pulse is generated, when the sound detecting step detects a first sound wave of the series of sound waves to control the electronic appliance and the edge pulse generation step generates the first edge pulse corresponding to the first sound wave, in a state where the edge pulse generation step does not generate the edge pulse for a first predetermined time; and a second gate generation step of generating a second gate having a second time width smaller than the first time width to detect whether or not a third sound wave of the series of sound waves has been generated after elapse of a third predetermined time from a second time when a second edge pulse is generated, when the edge pulse generation step generates the second edge pulse corresponding to the second sound wave within the first gate.

9. The control method of the electronic appliance according to claim 8, wherein the third predetermined time is a time obtained by subtracting a time of ½ of the second time width from a time between the first time and the second time.

10. The control method of the electronic appliance according to claim 8, further comprising:

a third gate generation step of generating one or a plurality of m-th gates (m is an integer of 3 or more and is smaller than n by 1) to detect whether or not one or a plurality of n-th sound waves (n is an integer of 4 or more) which are fourth and subsequent sound waves of the series of sound waves have been generated, and generating the m-th gates so that intervals between adjacent gates between the second gate and the m-th gate are the second predetermined time.

11. The control method of the electronic appliance according to claim 8, further comprising:

a third gate generation step of generating one or a plurality of m-th gates (m is an integer of 3 or more and is smaller than n by 1) to detect whether or not one or a plurality of n-th sound waves (n is an integer of 4 or more) which are fourth and subsequent sound waves of the series of sound waves have been generated, and generating the m-th gates so that intervals between adjacent gates between the second gate and the m-th gate are successively shortened.

12. The control method of the electronic appliance according to claim 11, wherein after the edge pulse generation step generates a third edge pulse corresponding to the third sound wave, the third gate generation step generates the m-th gates at a timing obtained by subtracting a predetermined error time from an interval between an n−1-th edge pulse corresponding to an n−1-th sound wave and an n−2-th edge pulse corresponding to an n−2-th sound wave.

13. The control method of the electronic appliance according to claim 8, further comprising:

a flag generation step of generating a no-sound flag indicating that the absorption of the sound wave by the sound detecting step has stopped to determine that the absorption of the sound wave has stopped, when the edge pulse generation step does not generate the edge pulses corresponding to the second and subsequent sound waves within the gates to detect the respective sound waves: and a control step of generating a control signal indicating a preset control operation with respect to the number of the edge pulses generated by the edge pulse generation step.

14. The control method of the electronic appliance according to claim 8, further comprising:

a division step of dividing the voice signal generated by the sound-electricity conversion step into a plurality of frequency bands and generating the voice signals of the plurality of divided frequency bands, wherein the edge signal generation step generates the plurality of edge signals based on the voice signals of the plurality of frequency bands, respectively, and the edge pulse generation step generates the plurality of edge pulses based on the plurality of edge signals.

* * * * *